US009663990B2

(12) United States Patent
Kramer

(10) Patent No.: US 9,663,990 B2
(45) Date of Patent: May 30, 2017

(54) LADDER ASSIST

(71) Applicant: Mark Allen Kramer, Dayton, TX (US)

(72) Inventor: Mark Allen Kramer, Dayton, TX (US)

( * ) Notice: Subject to any disclaimer, the term of this patent is extended or adjusted under 35 U.S.C. 154(b) by 57 days.

(21) Appl. No.: 14/637,289

(22) Filed: Mar. 3, 2015

(65) Prior Publication Data

US 2015/0252619 A1 Sep. 10, 2015

Related U.S. Application Data

(60) Provisional application No. 61/947,984, filed on Mar. 4, 2014, provisional application No. 61/971,214, filed on Mar. 27, 2014.

(51) Int. Cl.

| | |
|---|---|
| ***E06C 5/02*** | (2006.01) |
| ***E06C 5/36*** | (2006.01) |
| ***A62B 35/00*** | (2006.01) |
| ***E06C 7/18*** | (2006.01) |
| ***E06C 9/02*** | (2006.01) |

(52) U.S. Cl.

CPC ..... *E06C 5/36* (2013.01); *A62B 35/005* (2013.01); *E06C 5/02* (2013.01); *E06C 7/186* (2013.01); *E06C 9/02* (2013.01)

(58) Field of Classification Search

CPC ... E06C 5/36; E06C 7/183; E06C 7/18; E06C 7/165; A62B 35/005; A62B 35/0068; A62B 35/0056; A62B 35/0037; A62B 35/0043; A62B 35/0075; A62B 35/0081; A62B 35/0087; A62B 35/0093

See application file for complete search history.

(56) References Cited

U.S. PATENT DOCUMENTS

| | | | | |
|---|---|---|---|---|
| 304,420 | A * | 9/1884 | Fox | E06C 1/12 182/213 |
| 584,017 | A * | 6/1897 | Sewell | B60R 25/09 188/31 |
| 799,782 | A | 9/1905 | Ellinger | |
| 822,658 | A | 6/1906 | Emberson | |
| 987,258 | A | 3/1911 | Saling | |
| 1,004,284 | A | 9/1911 | Lehmann | |
| 1,093,020 | A | 4/1914 | Williams | |
| 1,170,390 | A | 2/1916 | Armstrong | |
| 1,502,490 | A | 7/1924 | Tack | |
| 1,916,208 | A * | 7/1933 | Diou | E06C 7/187 182/8 |
| 1,927,469 | A * | 9/1933 | Plumpton | A47L 3/04 182/8 |
| 1,955,473 | A | 4/1934 | Raymer | |
| 2,538,904 | A * | 1/1951 | Herod | E06C 7/186 123/198 A |
| 2,596,802 | A * | 5/1952 | Will | E05B 73/0076 292/288 |
| 2,641,401 | A * | 6/1953 | James | E06C 1/38 182/189 |

(Continued)

*Primary Examiner* — Katherine Mitchell
*Assistant Examiner* — Shiref Mekhaeil
(74) *Attorney, Agent, or Firm* — The Compton Law Firm, P.C.; Scott D. Compton

(57) ABSTRACT

The application is directed to a ladder assist that may be secured to a ladder for preventing falls when persons are using a ladder. The ladder assist is operationally configured to prevent falls during access and egress of a fixed ladder of a structure, e.g., a fixed ladder of a transportation container or a building.

16 Claims, 21 Drawing Sheets

(56) References Cited

U.S. PATENT DOCUMENTS 2,656,088 A 10/1953 White
2,680,554 A 6/1954 Dakin
2,881,028 A 4/1959 Baird
3,107,749 A 10/1963 Terlecky
3,131,928 A 5/1964 Whipple
3,136,384 A 6/1964 Sweeney
3,177,543 A 4/1965 Fountain
3,395,501 A * 8/1968 Davidson, Jr. ..... B66B 9/187 182/178.6
3,410,364 A 11/1968 Fountain
3,455,414 A * 7/1969 Higgins ..... E06C 7/182 182/106
3,523,591 A * 8/1970 Fountain ..... A63B 27/04 182/8
3,598,200 A * 8/1971 Thompson ..... E06C 7/186 182/106
3,885,647 A 5/1975 Acosta
3,908,791 A * 9/1975 Kleine ..... E06C 7/186 182/8
3,968,858 A 7/1976 Vollan
4,130,177 A 12/1978 Pandolph
4,232,759 A 11/1980 Jacobs
4,311,207 A 1/1982 Lurry
4,331,217 A 5/1982 Stecklow
4,352,409 A * 10/1982 Fountain ..... E06C 7/187 182/8
4,364,451 A * 12/1982 Wright ..... E06C 7/06 182/213
4,423,796 A 1/1984 Sulowski
4,546,855 A * 10/1985 Lyons ..... E06C 9/02 182/106
4,709,783 A * 12/1987 Tomioka ..... A62B 1/00 182/198
4,729,453 A * 3/1988 Lyons, Sr. ..... E06C 1/38 182/100
4,787,478 A 11/1988 Stakes, Jr.
4,798,262 A 1/1989 Margolies
4,848,517 A 7/1989 Broyles, III
4,942,943 A 7/1990 Flaherty
4,970,884 A * 11/1990 Solow ..... B60R 25/0225 70/209
5,022,697 A * 6/1991 Hettwer ..... B60P 1/43 280/783
5,035,299 A * 7/1991 Eisenberg ..... E06C 1/12 182/212
5,143,170 A 9/1992 Hunt
5,165,501 A 11/1992 Donahey
5,282,597 A 2/1994 Babcock
D346,106 S * 4/1994 Walls ..... D8/339
5,419,165 A * 5/1995 Perkins ..... E05B 67/383 292/258
5,447,346 A * 9/1995 Virzi ..... E05B 65/0888 292/258
5,724,839 A * 3/1998 Thering ..... B60R 25/09 70/18
5,743,356 A 4/1998 Mitchell
5,778,709 A * 7/1998 Hsu ..... B60R 25/0225 70/209
5,875,867 A * 3/1999 Beard ..... E04D 15/00 182/3
5,918,488 A * 7/1999 Deeter ..... B60R 9/0485 182/214
5,924,523 A * 7/1999 Krause ..... E06C 1/12 182/207
5,931,259 A 8/1999 Hoey
5,941,343 A 8/1999 Kelsey
6,012,546 A 1/2000 Bee
6,058,749 A * 5/2000 Rekemeyer ..... B60R 25/0221 70/14
6,092,625 A 7/2000 Bedrosian
6,095,283 A 8/2000 Ellis
6,116,065 A * 9/2000 Hale ..... B64C 13/14 180/90
6,152,261 A 11/2000 Hoey
6,244,383 B1 6/2001 Jung
6,260,662 B1 * 7/2001 Meister ..... E06C 1/381 182/106
6,269,904 B1 8/2001 Morhaus
6,311,530 B1 * 11/2001 Woodward ..... E05C 19/186 70/159
6,347,685 B1 2/2002 Ellis
6,394,229 B1 5/2002 Hastreiter
6,405,828 B1 6/2002 Redding
6,412,600 B1 7/2002 Wolfman
6,533,069 B1 3/2003 Couillard
6,553,797 B2 * 4/2003 Witchey ..... B60R 25/00 70/200
6,619,428 B2 9/2003 Ellis
6,619,708 B1 * 9/2003 Naylor ..... E05C 19/186 292/259 R
6,681,893 B1 1/2004 Coulson
6,829,914 B2 * 12/2004 Bullock ..... B60R 25/00 70/14
6,854,562 B2 2/2005 Kwak
6,913,114 B1 7/2005 Blehm
6,994,188 B2 2/2006 Hockensmith
7,014,594 B2 3/2006 Stoltz
7,174,993 B2 2/2007 Lantz
7,299,758 B1 * 11/2007 Bogart ..... B63C 3/06 114/44
7,377,360 B1 5/2008 Misiak
7,789,199 B2 9/2010 Wollenberg
7,971,838 B2 7/2011 Osborn
7,992,681 B2 8/2011 Anderson
8,100,369 B2 1/2012 Osborn
8,261,880 B1 * 9/2012 Hop ..... E06C 5/04 114/362
8,413,764 B1 * 4/2013 Cohen ..... E06C 7/18 182/62.5
8,875,839 B1 * 11/2014 Licea ..... A62B 35/005 182/5
8,876,429 B2 * 11/2014 Fay, Sr. ..... E05B 73/007 405/3
8,939,309 B2 * 1/2015 Meacham ..... B65D 90/22 220/314
9,284,751 B2 * 3/2016 Rickman ..... E05B 65/0089
2002/0112916 A1 8/2002 Ador
2005/0161284 A1 * 7/2005 Casebolt ..... E06C 7/186 182/3
2010/0044151 A1 2/2010 Vollenweider
2010/0078262 A1 4/2010 Townend
2010/0219015 A1 9/2010 Meillet
2010/0219016 A1 * 9/2010 Meillet ..... E06C 7/186 182/8
2011/0265685 A1 * 11/2011 Swygert ..... B61D 23/00 105/425
2012/0080263 A1 4/2012 Lee
2013/0270037 A1 * 10/2013 Pensieri ..... E06C 7/16 182/107

* cited by examiner

LADDER ASSIST

CROSS-REFERENCE TO RELATED APPLICATIONS

This application claims the benefit of U.S. provisional patent applications Ser. No. 61/947,984, filed on Mar. 4, 2014 entitled "Ladder Assist" and Ser. No. 61/971,214, filed on Mar. 27, 2014 entitled "Ladder Assist."

STATEMENT REGARDING FEDERALLY SPONSORED RESEARCH OR DEVELOPMENT

Not applicable.

FIELD OF THE APPLICATION

The application relates generally to a fall arrest ladder assist for use with ladders fixed to one or more structures such as buildings and containers used in the rail and related industries.

BACKGROUND OF THE APPLICATION

In the rail and related industries, a major source of injuries and fatalities results from falls during ladder access and egress. To date, safety procedures for preventing falls involve training individuals to maintain three points of contact with a ladder during access and egress, e.g., maintaining two hands and one foot or two feet and one hand on a ladder at all times. Unfortunately, the three points of contact procedure does not prevent falls altogether.

A portable, lightweight and easily storable fall arrest ladder assist that may be attached to a fixed ladder to prevent falls during ladder access and egress is desired. An advantageous fall arrest ladder assist is operationally configured to enhance safety procedures already being taught and implemented in the field.

BRIEF SUMMARY

The present application is directed to a ladder assist including (a) a telescoping assembly having a first ladder attachment assembly for engaging a fixed ladder at a first location of the ladder and a second ladder attachment assembly for engaging a ladder at a second location of the ladder; (b) a self-retractable lifeline in communication with the telescoping assembly; the first ladder attachment assembly and the second ladder attachment assembly being operationally configured to apply opposing forces to the ladder for securing the telescoping assembly to the ladder.

The present application is also directed to a ladder assist including (a) a telescoping assembly having a first ladder attachment assembly for engaging a ladder rung and a second ladder attachment assembly for engaging a different ladder rung, the first and second attachment assemblies being operationally configured to apply opposing forces to the ladder rungs in a manner effective to secure the telescoping assembly to the ladder; and (b) a self-retractable lifeline reel in connection with the telescoping assembly in a manner effective to conceal at least part of the lifeline extending out from the reel within the telescoping assembly.

The present application is also directed to a method of preventing a fall during access and egress of a fixed ladder of a transportation carrier comprising (a) providing a ladder assist having a telescoping assembly and a self-retractable lifeline, the telescoping assembly including a first hook member for engaging a lowermost rung of the fixed ladder and a second hook member for engaging an uppermost rung of the fixed ladder, the first hook member being (1) attached to a moveable member secured to the telescoping assembly and (2) operationally configured to provide an applied force to the lowermost rung, the second hook member being operationally configured to apply an opposing applied force to the uppermost rung, the telescoping assembly further including one or more lateral members extending out from telescoping assembly in a manner effective to contact a frame of the fixed ladder to prevent horizontal movement of the telescoping assembly; (b) with the telescoping assembly in an extended position securing the telescoping assembly to the fixed ladder by placing the first and second hook members in engagement positions with the lowermost and uppermost rungs and securing at least one lateral member to the frame of the fixed ladder; and (c) attaching a free end of the lifeline to a user of the fixed ladder during operation of the ladder assist.

DETAILED DESCRIPTION

Figure 1:
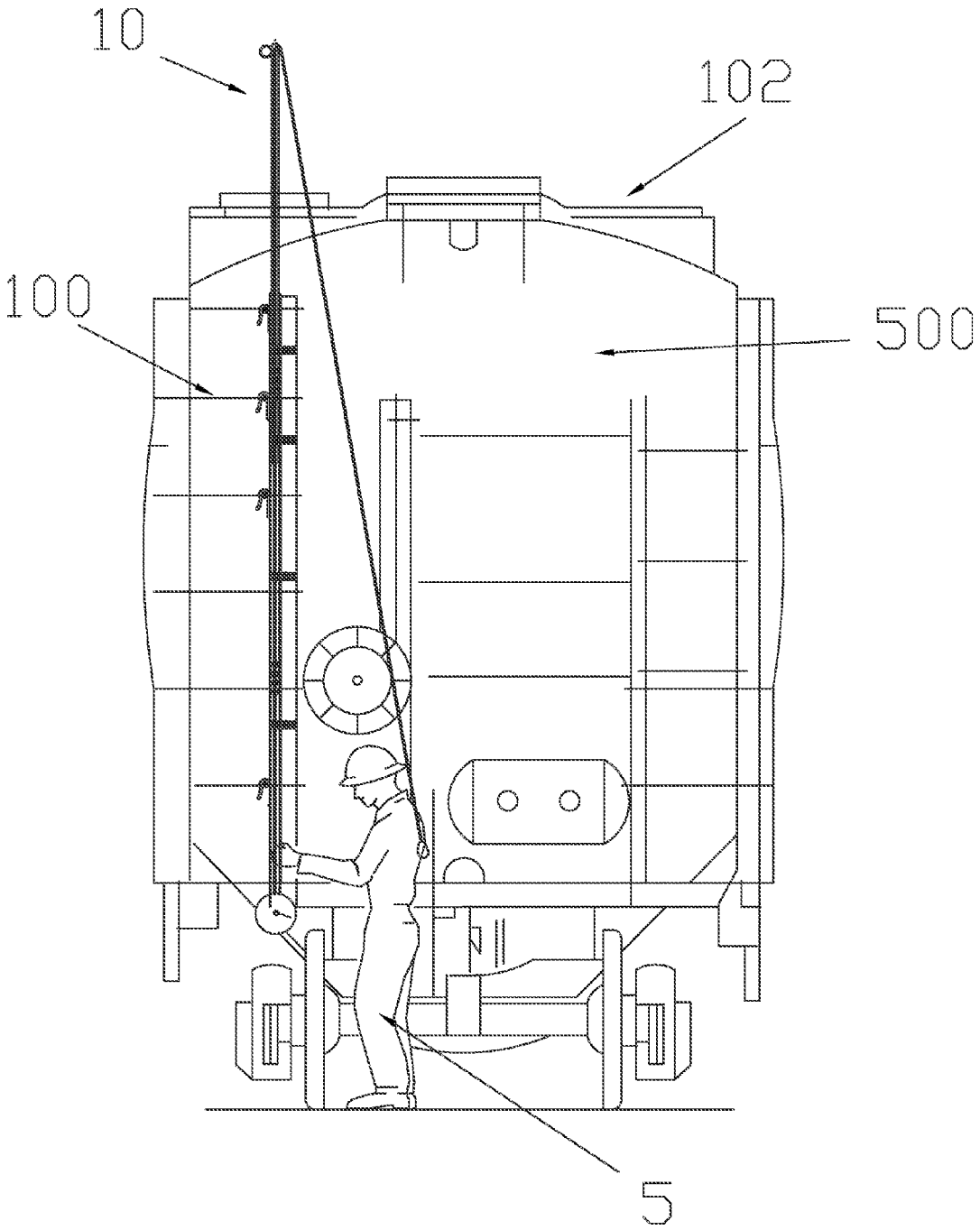
FIG. 1 is a simplified illustration of an embodiment of a fall arrest ladder assist assembly of the present application secured to a fixed ladder of a railcar in an extended position.

Before describing the invention in detail, it is to be understood that the present ladder assist assembly, system and method are not limited to particular embodiments. It is also to be understood that the terminology used herein is for the purpose of describing particular embodiments only, and is not intended to be limiting. As used in this specification and the appended claims, the phrases "container ladder" and "fixed ladder" refer to a straight type ladder fixed to the side of a structure including ladders providing access to the roof or top portion of a structure. The term "stability" means securing a ladder assist assembly to a fixed ladder in a manner effective to prevent vertical and horizontal movement of the ladder assist assembly relative the ladder. The phrase "transportation container" may include, but is not necessarily limited to a railway car, a freight car, a highway carrier, a cargo container, and combinations thereof. The term "freight car" may include, but is not necessarily limited to a boxcar, a hopper car, a gondola, a livestock car, a tank car, and combinations thereof. The phrase "applied force" is a vector quantity having both a magnitude and a direction.

In one aspect, the application provides a ladder assist or "fall arrest ladder assist" assembly, system and method for preventing falls during access and egress of a fixed ladder of a transportation carrier. In one operable embodiment the ladder assist includes:

(a) providing a retractable member releasably attachable to a fixed ladder, the retractable member including a main frame having a first section operationally configured to releasably attach to a rung of the ladder at a first altitude, a second section operationally configured to releasably attach to a rung of the ladder at a second altitude, a third section defining the distal end of the main frame, one or more side rail attachments for securing the retractable member to the ladder, and a fall arrest system attached to the retractable member, the fall arrest system being operationally configured to support an individual during ladder access and egress; wherein the first and section sections of the retractable member include counterweighted locking members operationally configured to secure the retractable member to rungs of the ladder, and wherein the fall arrest system includes a retractable anchor reel and pulley and a cable connected to the retractable anchor at a first end a free second end for securing a user of the ladder thereto;

(b) with the retractable member in an extended position, setting the retractable member on a target ladder by attaching the locking member of the second section to the uppermost rung of the ladder and attaching the locking member of the first section to the lowermost rung of the ladder; thereafter (c) attaching the free end of the cable to a harness worn by an individual to climb the ladder;

(d) attaching the retractable member to a side rail at one or more points prior to an individual ascending the ladder;

(e) detaching the free end of the cable to the harness once an individual is clear of the top end of the ladder;

(f) reattaching the free end of the cable to the harness prior to the individual descending the ladder;

(g) during descent, the individual detaches the retractable member from the side rail of the ladder; and (h) once an individual has fully descended to ground level, the individual detaches the cable from the harness and detaches the retractable member from the ladder.

In another aspect, the present application provides a fall arrest ladder assist assembly and system for preventing falls during access and egress of a fixed ladder of a transportation carrier similar as the method described in the previous paragraph, the assembly including a retractable member releasably attachable to a fixed ladder, the retractable member including a main frame having first and second sections operationally configured to releasably attach to differing rungs of a ladder, the second section of the main frame defining the distal end of the main frame.

In another aspect, the application provides a fall arrest ladder assist assembly permanently attachable or releasably attachable to a fixed ladder, the assembly including a fall arrest in communication with the ladder assist and an individual using the ladder.

In another aspect, the application provides an extendible fall arrest ladder assist assembly that may be permanently or releasably secured to a fixed ladder and operationally configured to protect an individual from falling to ground level during ladder access and egress. The fall arrest ladder assist is suitably operationally configured to prevent movement of the ladder assist along three axes relative the fixed ladder.

In another aspect, the application provides a fall arrest ladder assist assembly including (1) three telescoping sections and (2) a cable system securable to an individual to minimize or prevent slip or fall travel distance of an individual during ladder access and egress. The application also provides a method for attaching and securing the assembly to a fixed ladder.

In another aspect, the application provides a fall arrest ladder assist assembly including (1) two telescoping sections and (2) a cable system securable to an individual to minimize or prevent slip or fall travel distance of an individual during ladder access and egress. The application also provides a method for attaching and securing the assembly to a fixed ladder.

In another aspect, the application provides a portable fall arrest ladder assist assembly. The assembly may be used on various sized fixed ladders including, but not necessarily limited to ladders fixed to transportation containers. The assembly may be lightweight for ease of manual portability by an individual. Suitably, the assembly may be operated with minimal training or mechanical aptitude.

In another aspect, the application provides a portable fall arrest ladder assist assembly, system and method operationally configured to protect an individual as he/she climbs a fixed container ladder.

In another aspect, the application provides a portable fall arrest ladder assist assembly including a retractable arresting cable system that is attached to an individual's body safety harness or similar device.

In another aspect, the application provides a portable fall arrest ladder assist assembly including two or more telescoping sections with attachment members for attaching the assembly to a fixed ladder. In one particular embodiment, the attachment members have "J" type hooks including counter weighted locking mechanisms, each being operationally configured to attach to a ladder rung. The counter weight employed assures that the "J" type hook is secured to the ladder rung during operation of the assembly preventing the assembly from becoming dislodged from the fixed ladder as an individual using the ladder assist ascends and/or descends the ladder. Integral to the assembly is an additional arresting system including a retractable safety reel that is threaded through the inner portion of the telescoping sections to provide fall arrest for an individual. The fall arrest is intended to minimize the distance of a person's fall to about 0.61 meters (about 2.0 feet) or less to minimize possible injury. In one particularly advantageous embodiment, the fall arrest may be operationally configured to minimize the distance of a person's fall up to about 5.08 cm (about 2.0 inches).

In another aspect, the application provides a method of preventing falls during access and egress of a fixed ladder of a transportation carrier comprising (1) providing a retractable member releasably attachable to the ladder, the retractable member including a first section operationally configured to releasably attach to a rung of the ladder at a first altitude, a second section operationally configured to releasably attach to a rung of the ladder at a second altitude, a third section defining the distal end of the main frame, one or more side rail attachments for securing the retractable member to the ladder, and a fall arrest system attached to the retractable member, the fall arrest system being operationally configured to support an individual during access and egress along the ladder; wherein the first and section sections of the retractable member include counterweighted locking members operationally configured to secure the retractable member to rungs of the ladder, and wherein the fall arrest system includes a retractable anchor reel and pulley and a cable connected to the retractable anchor at a first end a free second end for securing a user of the ladder thereto; (2) with the retractable member in an extended position, setting the retractable member on the ladder by attaching the locking member of the second section to the uppermost rung of the ladder and attaching the locking member of the first section to the lowermost rung of the ladder; (3) attaching the free end of the cable to a harness worn by the ladder user; (4) attaching the retractable member to a side rail at one or more points when ascending the ladder; (5) detaching the free end of the cable to the harness once the user is atop the carrier; (6) reattaching the free end of the cable to the harness prior to descending down the ladder; (7) unattaching the retractable member from the side rail during descension; and (8) once fully descended, detaching the cable from the harness and detaching the retractable member from the ladder.

In another aspect, the application provides a ladder assist assembly including (1) an elongated member operationally configured to releasably attach to a ladder; (2) the elongated member including at least (a) a first attachment member operationally configured to attach to the ladder at a first altitude, (b) a second attachment member operationally configured to attach to the ladder at a second altitude, and (c) a fall arrest system attached thereto; (3) wherein the fall arrest system includes a retractable anchor disposed between the first and second attachment members, a pulley at a distal end of the elongated member and a cable in communication with the retractable anchor and pulley, the cable attaching to the retractable anchor at a first end and having an attachment member at a second end.

In another aspect, the application provides a ladder assist assembly including (1) an elongated member operationally configured to releasably attach to a ladder; (2) the elongated member including at least (a) a first attachment member operationally configured to engage the ladder at a first altitude, (b) a second attachment member operationally configured to engage the ladder at a second altitude, and (c) a fall arrest system attached thereto; (3) wherein the fall arrest system includes a retractable anchor disposed between the first and second attachment members, a pulley at a distal end of the elongated member and a cable in communication with the retractable anchor and pulley, the cable attaching to the retractable anchor at a first end and having an attachment member at a second end. At least part of the cable being enclosed within the elongated member.

In another aspect, the application provides a ladder assist assembly including (1) an extendable member operationally configured to releasably attach to a ladder; (2) the extendable member including at least (a) a first attachment member operationally configured to attach to the ladder at a first altitude, (b) a second attachment member operationally configured to attach to the ladder at a second altitude, and (c) a fall arrest system attached thereto; wherein the fall arrest system includes a retractable anchor, a pulley at a distal end of the extendable member and a cable in communication with the retractable anchor and pulley, the cable running through the extendable member attaching to the retractable anchor at a first end and having an attachment member at a second end.

In another aspect, the application provides a ladder assist assembly including (1) a retractable main frame member releasably attachable to a ladder, the main frame member including a first section operationally configured to releasably attach to the ladder at a first altitude, a second section operationally configured to releasably attach to the ladder at a second altitude, and a third section defining the distal end of the main frame; (2) a fall arrest system attached to the main frame, the fall arrest system being operationally configured to support an individual during access and egress along the ladder.

In another aspect, the application provides a system for providing access to the roof of a transportation carrier including (1) a ladder fixed to the side of the transportation carrier, the ladder having opposing side rails and a plurality of rungs disposed there between; (2) a retractable member operationally configured to be releasably secured to at least one side rail and one or more rungs of the ladder; and (3) a fall arrest system in communication with the retractable member, the fall arrest system having a retractable anchor and pulley attachable to the retractable member, and a cable in communication with the retractable anchor and pulley, the cable running through the retractable member attaching to the retractable anchor at a first end and having a free second end for securing to a harness.

For simplicity and without limiting the invention, the fall arrest ladder assist assembly, system and method will be discussed in terms of use in conjunction with ladders fixed to a transportation carrier 500 as shown in FIG. 1. Suitably, the present fall arrest ladder assist assembly 10 (hereafter "assembly") is operationally configured to be releasably secured to a fixed ladder 100 in a manner effective to provide fall arrest to an individual 5 during ladder access and egress and assist an individual 5 in accessing and departing the top 102 of a transportation container 500. Without limiting the invention to a particular embodiment, one suitable assembly 10 may be retractable having two or more coaxial sections or members for securing to a fixed ladder 100 (hereafter "ladder") on-site in real time. It is also contemplated that in another embodiment, the assembly 10 may be provided as a static type member having a predetermined length for securing to a ladder 100 on-site in real time.

Figure 2A:
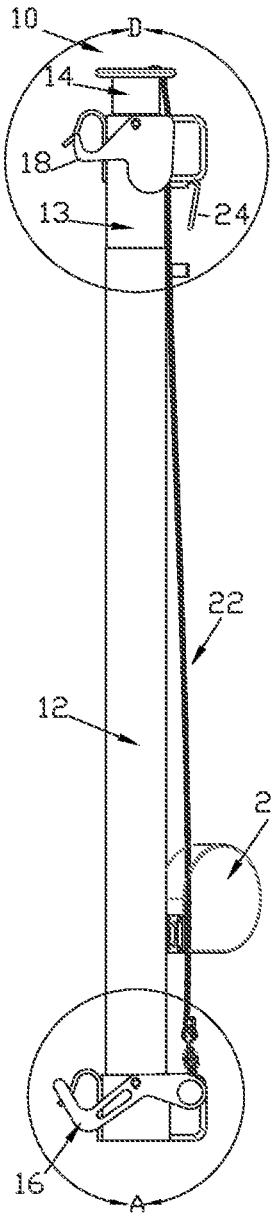
FIG. 2A is a side view of a fall arrest ladder assist assembly.
Figure 2B:
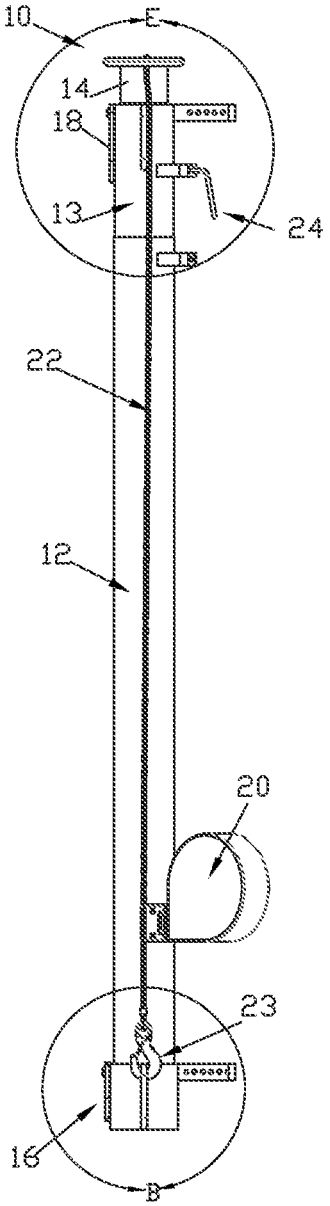
FIG. 2B is another side view of the fall arrest ladder assist assembly of FIG. 2A.
Figure 2C:
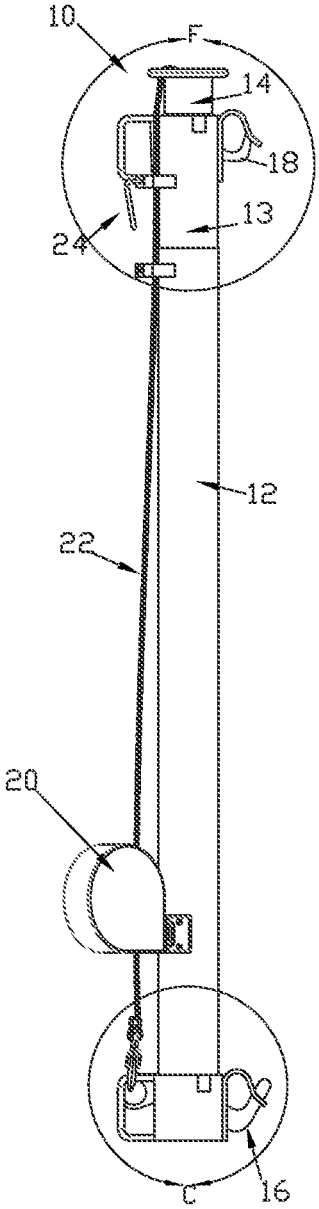
FIG. 2C is another side view of the fall arrest ladder assist assembly of FIGS. 2A and 2B.

Turning to FIGS. 2A-2C, one suitable retractable assembly 10 may include at least (1) a hollow first member 12, (2) a hollow second member 13 and (3) a hollow third member 14 coaxially aligned in a telescoping manner. The assembly 10 may be operationally configured to extend out to a desired length according to (a) one or more particular assembly 10 applications, (b) the size of one or more target structures and/or (c) the length of ladders affixed to such structures. As shown, the assembly 10 may also be configured to retract to an overall length slightly greater than the length of the first member 12, e.g., up to about 30.0% greater in length than the length of the first section 12.

Suitably, the assembly 10 includes at least one ladder attachment for releasably securing the assembly 10 to a ladder 100. In the embodiment of FIGS. 2A-2C, the assembly 10 includes a first attachment assembly 16 disposed along the first member 12 and a second attachment assembly 18 disposed along the second member 13. The first attachment assembly 16 is suitably effective to releasably engage a ladder 100 at a first location and the second attachment assembly 18 is suitably effective to releasably engage a ladder at a second location. As shown, the first attachment assembly 16 may be operationally configured to releasably attach to a rung lower on a ladder 100, i.e., closer to the ground or support surface, than a rung for releasable attachment of the second attachment assembly 18. Without limiting the points of attachment of a particular assembly 10 to a particular target ladder 100, the first and second attachment assemblies 16, 18 are suitably attached to particular rungs of a ladder 100 at altitudes relative to one another and/or relative to the top 102 of a railcar effective for (1) providing stability to the assembly 10 during use and/or (2) extending the distal end of the assembly 10 to a desired altitude above the top 102 of a railcar. In one non-limiting embodiment, a first attachment assembly 16 may be secured to a bottom-most rung of a ladder 100 and a second attachment assembly 18 may be secured to an uppermost rung of the ladder 100. Herein, the first and second attachment assemblies 16, 18 may be defined as "primary attachments" of the assembly 10.

Still referring to FIGS. 2A-2C, the assembly 10 also suitably includes a fall arrest system in the form of a self-retractable lifeline as understood by the skilled artisan. As such, the assembly 10 is operationally configured to be secured to a ladder 100 in a manner effective to provide anchorage for a user of the assembly 10 during access and egress. Suitably, the fall arrest system includes a retractable reel 20 and lifeline 22 as known in the art. As shown in FIGS. 2A-2C, the retractable reel 20 is in communication with the first section 12, attached along the outer surface of the first section 12, i.e., the lowermost section, wherein it is operationally configured to act as a counter-balance of the assembly 10 and provide ease of access of the retractable reel 20. In another embodiment, the retractable reel 20 may be attached at another point along the assembly 10 effective to provide a desired counter-balance to the assembly 10 and ease of access as desired.

In one embodiment, the lifeline 22 may include a hook or other coupling at its distal end for releasably attaching the lifeline 22 to a user, e.g., a user's body support or body wear as the terms are understood by persons of ordinary skill in the art. Typical body wear may include body harnesses and/or body belts worn by individuals 5. In another embodiment, the fall arrest system may include a lanyard or the like attached at the distal end of a lifeline 22, the lanyard being operationally configured to releasably attach to a body harness or belt worn by an individual 5. One suitable lanyard may include an energy-absorbing lanyard. With attention to FIG. 2B, the fall arrest system suitably employs a connector 23 for attaching to body support or body wear. Suitable connectors 23 may include, but are not necessarily limited to hooks, snaphooks, carabiners, D-rings, O-rings, buckles, and combinations thereof.

Suitably, the members 12, 13 and 14 may be hollow or include openings there through allowing the lifeline 22 to run from the retractable reel 20 through the assembly 10 and out through an aperture located near the distal end of the third member 14. In container operation, the distal end of the third member 14 is located at an altitude greater than the container ladder 100 as shown in FIG. 1. As such, the third member 14 may include a pulley or other surface (discussed below) operationally configured to promote travel of the lifeline 22 at its bending point.

For the purpose of this application, suitable retractable reels 20 may include, but are not necessarily limited to deceleration devices such as inertia reels. Suitable lifelines 22 may include cables, ropes, stretchable cords, and combinations thereof. Suitable cables may be constructed from one or more metals, synthetic materials, and combinations thereof. One suitable cable may be constructed from stainless steel. Another suitable cable may be constructed from corrosion-resistant stainless steel and aluminum internal components. A suitable bend radius of cable may range from about 15.0 degrees to about 180.0 degrees. Suitable ropes may be constructed from organic fibers, synthetic fibers and combinations thereof. A suitable bend radius of a rope may range from about 15.0 degrees to about 180.0 degrees. Suitable stretchable cords may be constructed from one or more polymeric materials. A suitable bend radius of a stretchable cord may range from about 15.0 degrees to about 180.0 degrees.

Although the assembly 10 of this application may be built to scale, in typical industrial applications a suitable fall arrest system of the assembly 10 includes a retractable reel 20 and lifeline 22 operationally configured to hold up to about 136.1 kg (about 300.0 pounds). As a skilled artisan will appreciate, the hold rating of the retractable reel 20 and lifeline 22 may be altered as desired or as otherwise required.

Figure 11:
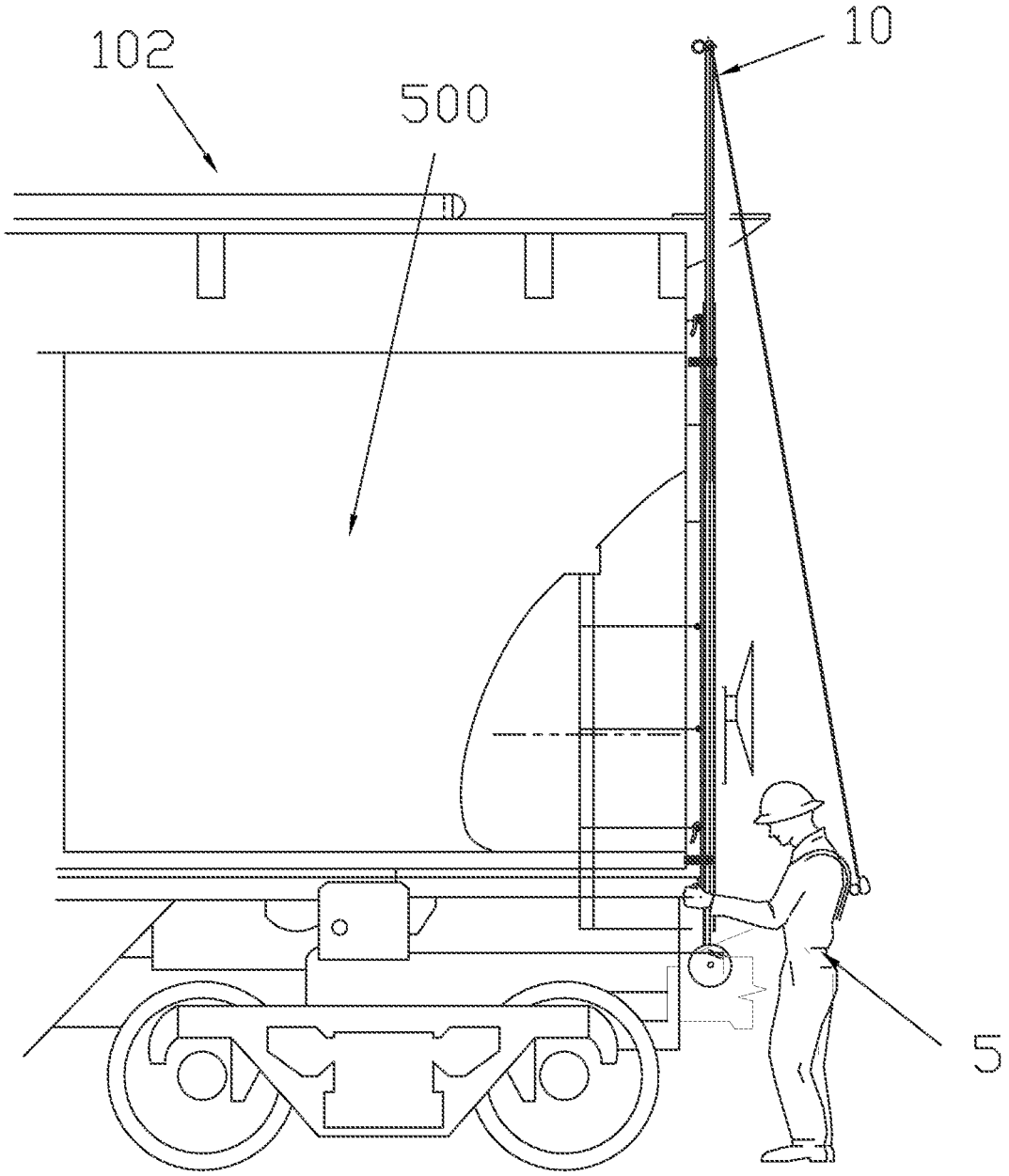
FIG. 11 is a simplified illustration of a fall arrest ladder assist assembly of the present application secured to a fixed ladder of a railcar.

In addition, various industries are often governed by rules or regulations requiring use of fall arrests in situations where an individual 5 will be working at a certain height above ground level. For example, in railcar type settings the top 102 of the railcar 500, i.e., the working platform, is typically at least about 4.11 meters (about 13.5 feet) above ground level (see FIGS. 1 and 11) and the distal end of the ladder 100 is about even with the top 102. As such, in railcar 500 applications the distal end of the third member 14 is suitably set at least about 0.91 meters (about 3.0 feet) above the top 102 of the corresponding railcar 500 whereby the fall arrest system is operationally configured to minimize the travel distance of an individual's accidental fall to about 0.61 meters (about 2.0 feet) or less. As stated above, in one particular embodiment the fall arrest may be operationally configured to minimize the distance of a person's fall to about 5.08 cm (about 2.0 inches). In other words, in the event an individual 5 falls from the top 102 of a railcar 500, the assembly 10 is operationally configured to maintain the individual 5 a safe distance apart from the ground or rail below by minimizing the travel distance of an individual 5 post fall.

As common in the art of telescoping devices, the assembly 10 members 12, 13 and 14 are operationally configured to expand and retract as desired. In one embodiment, the members 12, 13 and 14 may be provided as interlocking members. As known in the art of telescoping members, an inner telescoping member is slidably received within an outer telescoping member that is provided with a plurality of longitudinally aligned openings there through. An inner telescoping member of this application may include a biased pin type device operationally configured to extend through an aperture along the outer telescoping member for engagement there through. To adjust the height or length of the assembly 10, the pin type device may be depressed inwardly against the force of its related biased member, e.g., a spring, and the inner telescoping member may be slidably moved within the outer telescoping member until the pin type device is aligned with another aperture along the outer telescoping member, whereupon the spring outwardly biases the pin type device into engagement with the aperture to lock the inner and outer telescoping members in a fixed position.

In another embodiment, the members 12, 13 and 14 may be provided as non-interlocking members wherein each of the inner members 13 and 14 may be operationally configured to expand a predetermined distance forming the length of the assembly 10. In operation, the first and second members 12, 13 may be maintained in an expanded position as a result of being secured to a container ladder 100. In another embodiment, removable pins may be used to hold the first and second members 12, 13 in an expanded position. In one suitable embodiment, the second and third members 13, 14 may be held in an expanded position via a mating member 24 (see FIGS. 2B and 2C). Without limiting the invention, suitable mating members 24 may include, but are not necessarily limited to pins, dowels, J-Hooks and similar male type members or objects effective for mating with apertures through the walls of the second and third members 13, 14. When retracting the assembly 10, the mating member 24 may be removed from the aperture of the third member 14 allowing the third member 14 to slide within the second member 13.

As common to telescoping devices, each of the inner members 13 and 14 may have outer surfaces that substantially abut, or at least partially abut, the inner surfaces of the larger corresponding outer member 12 and 13. In one suitable embodiment, when fully expanded the members 12, 13, 14 may overlap internally up to about one-fifth (⅕) the length of each of the members 12, 13, 14. For example, in an embodiment where each of the members 12, 13, 14 has a length of about 1.52 meters (about 5.0 feet), each member 12, 13, 14 may overlap up to about 30.48 cm (about 1.0 foot) in a manner effective to provide structural strength to the assembly 10 during operation. In one embodiment, the members 12, 13, 14 may be separated into individual sections or parts for ease of transport as desired. In an advantageous embodiment, the assembly 10 may be configured to maintain the members 12, 13, 14 in telescoping communication whereby the assembly 10 may be transported in (1) a fully retracted position as depicted in FIGS. 2A-2C or (2) a partially or fully extended position as desired.

Figure 3C:
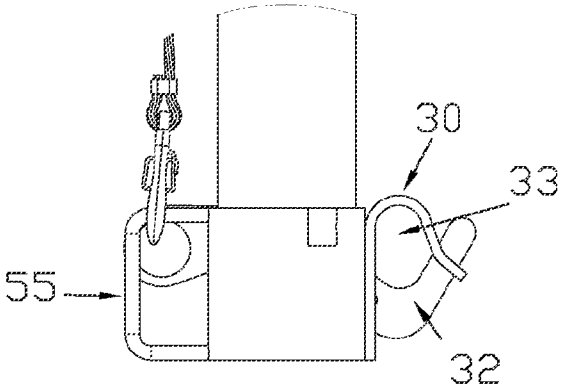
FIG. 3C is another detailed view of the first attachment assembly of FIGS. 3A and 3B.
Figure 3B:
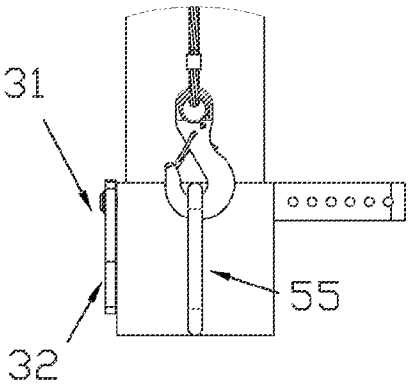
FIG. 3B is another detailed view of the first attachment assembly of FIG. 3A.
Figure 3A:
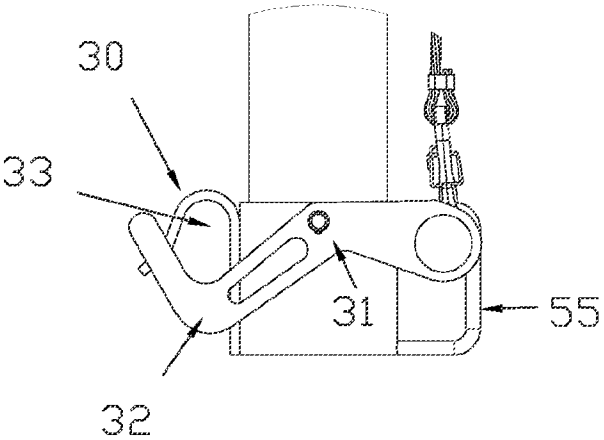
FIG. 3A is a detailed view of a first attachment assembly.

Details A-C of the first attachment assembly 16 as shown in FIGS. 2A-2C are further depicted in FIGS. 3A-3C. As shown, the first attachment assembly 16 includes a first hook member 30 operationally configured to rest atop a ladder rung and a first keeper 32 operationally configured to enclose a ladder rung for added security of the first attachment member 16. Although the first hook member 30 may be configured as desired, one first hook member 30 suitably includes a substantially smooth outer surface of a given width, length, thickness and shape. As shown in FIGS. 3A and 3C, the first hook member 30 may include an upside down "J" type configuration. Suitably, the contact surface 33 of the first hook member 30 is configured to substantially correspond to the outer surface configuration of a ladder rung—which is commonly cylindrical in relation to container ladders 100. The width of the hook member 30 may vary as desired, however the first hook member 30 suitably includes a width for providing stability and/or strength to an assembly 10 during use. Likewise, the first hook member 30 suitably includes a length great enough so that the distal ends of the first hook member 30 are located nearer the ground or support surface than the corresponding ladder rung in a manner effective to guard against the first hook member 30 slipping off in a horizontal direction away from the corresponding ladder rung during assembly 10 operation. As understood by the skilled artisan, a common rung 101 of a container ladder 100 has a diameter of about 2.54 cm (about 1.0 inches)—for example, see rung 101 in FIG. 4B. As such, one suitable first hook member 30 for railcar applications may include a "J" type configuration including a contact surface with a distal end extending out to about 10.16 cm (about 4.0 inches) from its central turning point. In one embodiment, "J" type hook members may be formed from material bent or shaped to form. In another embodiment, "J" type hook members may be constructed from load-carrying fabricated plate. In another embodiment, "J" type hook members may be constructed from a mold. In another embodiment, "J" type hook members may be constructed from an assembly of two or more material components.

Figure 3D:
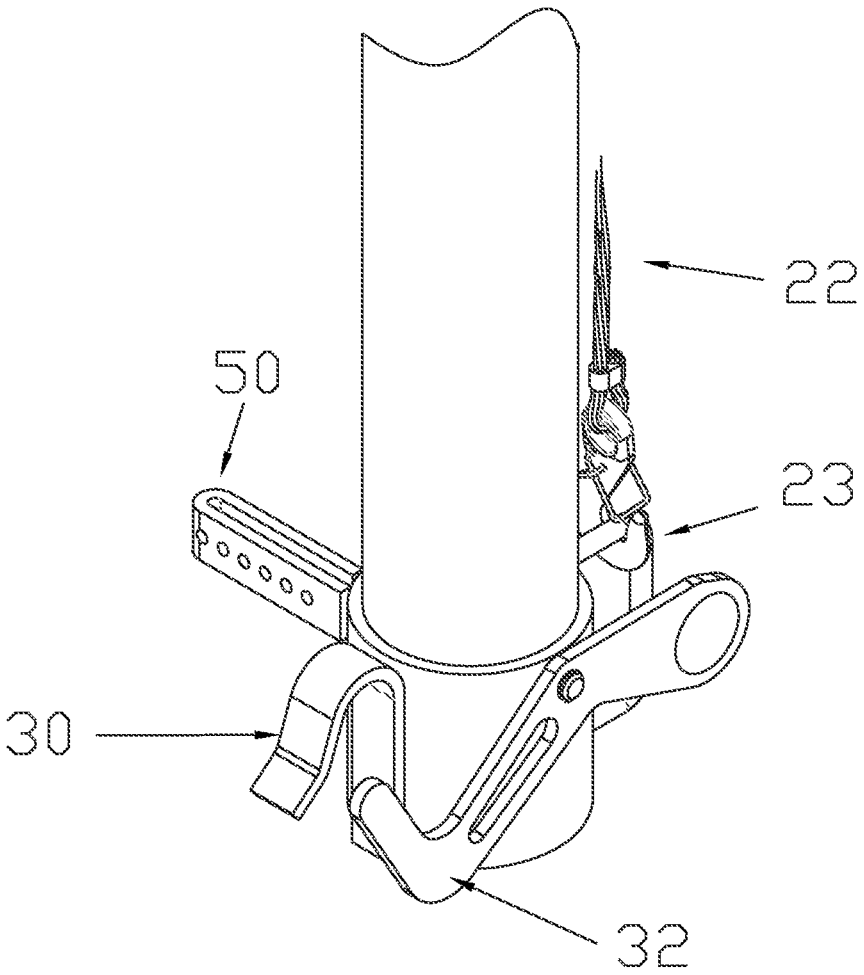
FIG. 3D is a detailed perspective view of the first attachment assembly of FIGS. 3A, 3B and 3C.
Figure 4A:
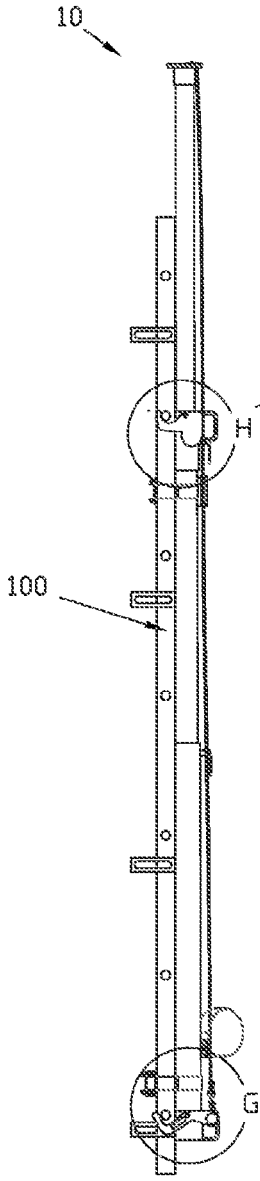
FIG. 4A is a simplified side view of a fall arrest ladder assist assembly attached to a ladder of a transportation container.
Figure 4C:
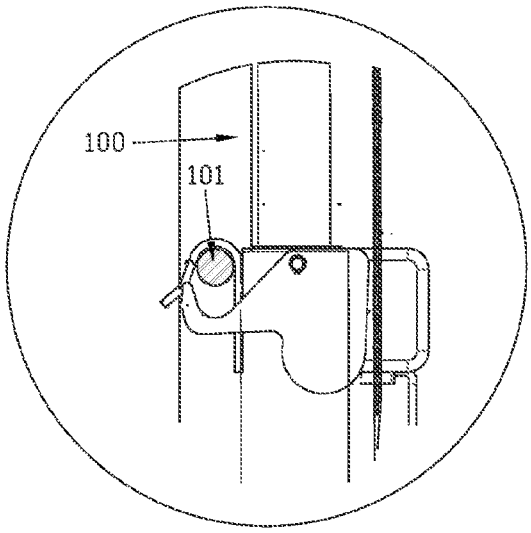
FIG. 4C is a detailed view of the second attachment assembly of FIG. 4A.
Figure 4B:
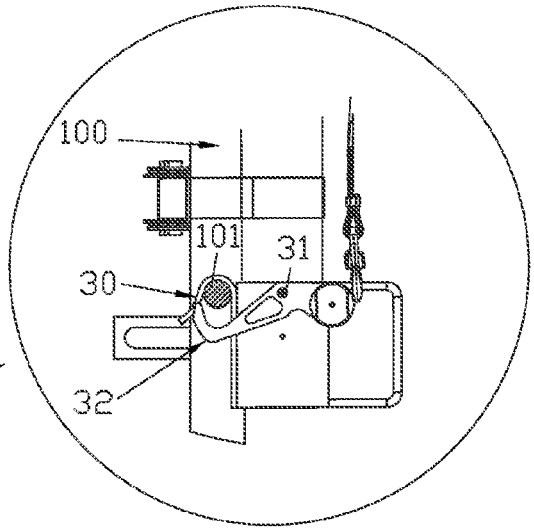
FIG. 4B is a detailed view of the first attachment assembly of FIG. 4A.

Still referring to FIGS. 4A and 4B, the first keeper 32 is suitably provided as a curved or angled counterweighted member pivotally mounted to the first member 12 via first pivot pin 31 or the like. In operation, once the assembly 10 is set in place on corresponding ladder rungs 101, the first keeper 32 may be pivoted by applying force manually against the first keeper 32 whereby the counterweighted configuration of the first keeper 32 allows the first keeper 32 to remain in a locked position about a ladder rung 101 as shown in FIGS. 4A and 4B, Without limiting the invention, a suitable first keeper 32 may pivot about the first pivot pin 31 up to about 90.0 degrees. The position of the first keeper 32 adjacent the first hook member 30 is further illustrated in FIG. 3D, which depicts the positioning of the first keeper 32 adjacent the first hook member 30 and illustrates an exemplary size and shape of the first hook member 30 relative to the first keeper 32 and the first section 12.

Figure 5C:
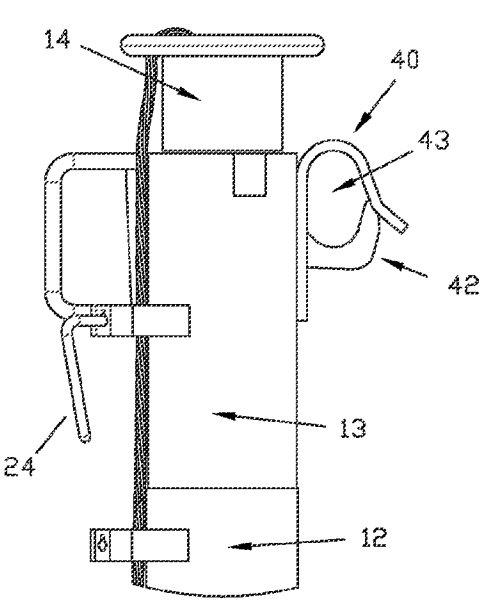
FIG. 5C is another detailed view of the second attachment assembly of FIG. 5A and 5B.
Figure 5B:
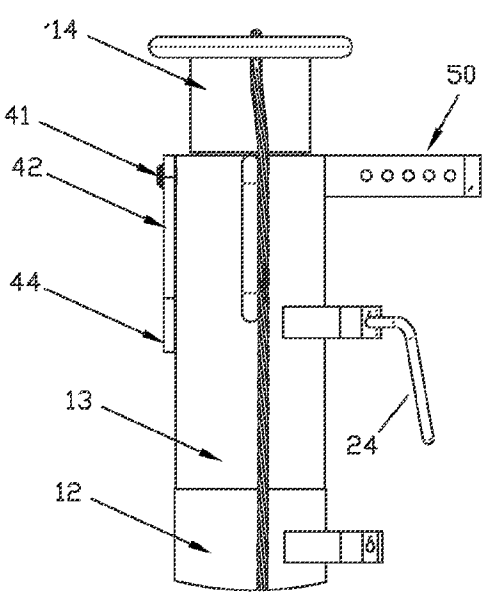
FIG. 5B is another detailed view of the second attachment assembly of FIG. 5A.
Figure 5A:
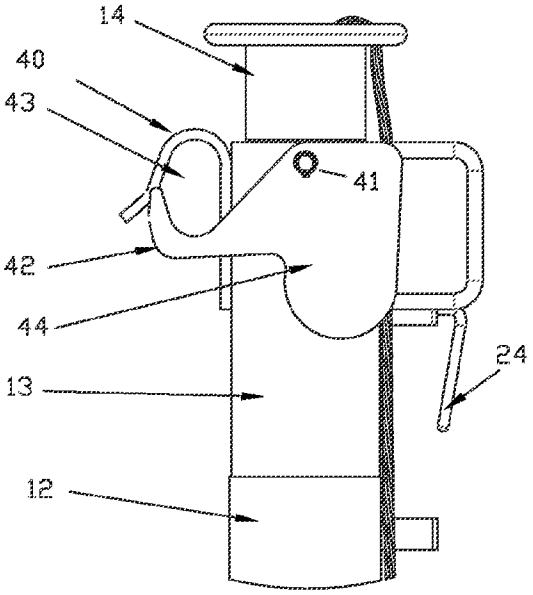
FIG. 5A is a detailed side view of a second attachment assembly of the present application.

Details D-F of the second attachment assembly 18 are further illustrated in FIGS. 5A-5C. As shown, the second attachment assembly 18 of this embodiment suitably includes a second hook member 40 operationally configured to rest atop a ladder rung 101 and a second keeper 42 operationally configured to enclose a ladder rung for added security of the second attachment assembly 18. Suitably, the second hook member 40 may include a configuration and characteristics similar as the first hook member 30 described above. As such, the second hook member 40 may include an upside down "J" type configuration similar to the first hook member 30 including an inner surface 43 corresponding in shape to the outer surface configuration of a ladder rung 101 (see for example FIGS. 5A and 5C). A suitable second hook member 40 includes a "J" type configuration with a contact surface extending out to about 10.16 cm (about 4.0 inches) from its central turning point.

Still referring to FIGS. 5A and 5C, the second keeper 42 is provided as a curved or angled counterweighted member pivotally mounted to the second member 13 via a second pivot pin 41 or the like. In particular, the second keeper 42 includes an ear 44 configured in a manner effective to maintain the second keeper 42 in a locked position about a ladder rung 101. In operation, once the assembly 10 is set in place on ladder rungs, the second keeper 42 may be pivoted by applying force manually against the second keeper 42 whereby the car 44 is operationally configured to maintain the second keeper 42 in the locked position as shown in FIG. 4C, Without limiting the invention, a suitable second keeper 42 may pivot about the second pivot pin 41 up to about 90.0 degrees.

Figure 6B:
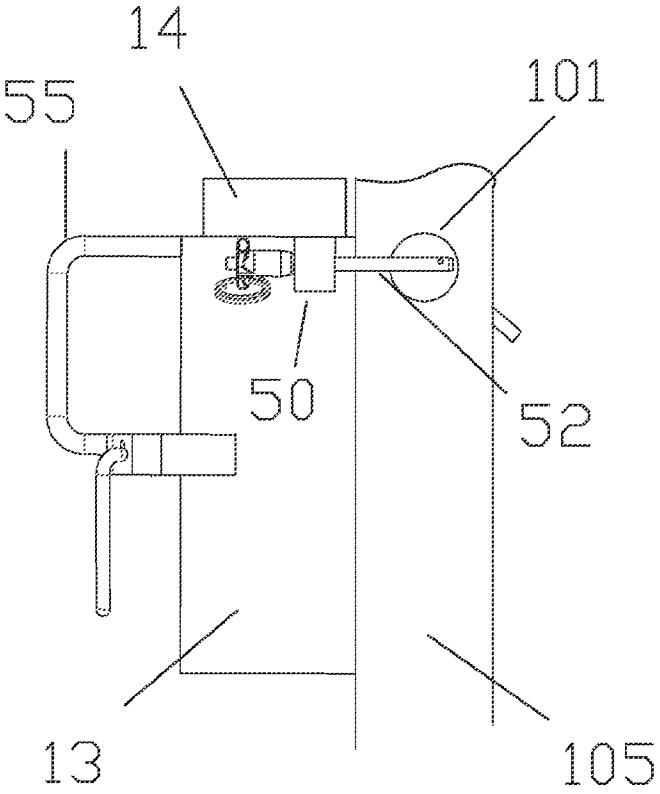
FIG. 6B is another detailed view of the second member of FIG. 6A.
Figure 6A:
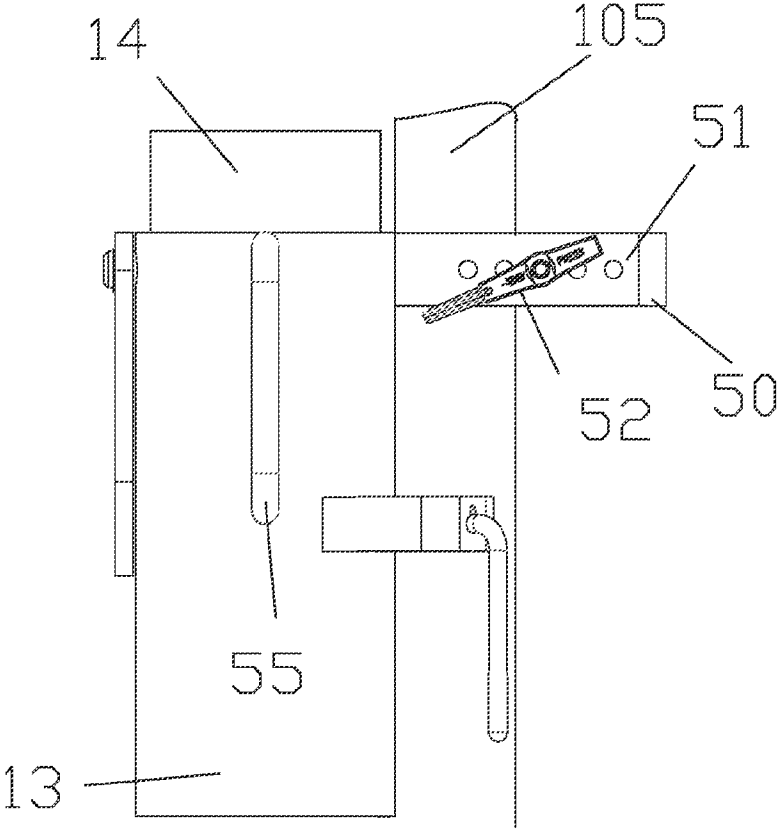
FIG. 6A is a simplified detailed view of a second member in attachment to a ladder.

With particular attention to FIGS. 6A and 6B, the second member 13 may further include a lateral member in the form of an arm 50 extending from the second member 13 as shown. Suitably, the arm 50 is defined by a longitudinal axis lying substantially perpendicular to the central axis A-A of the assembly 10. As shown, the arm 50 may include one or more apertures 51 for receiving a locking member 52 there through. In operation, the locking member 52 is mated with an aperture 51 in a manner effective to prevent or minimize horizontal movement of the assembly 10 toward the midline of the container ladder 100 during operation, i.e., minimize horizontal or lateral movement. In another embodiment, a clamp or similar device may be secured to the arm 50 in a manner effective to contact the ladder frame 105 to prevent or minimize horizontal movement of the assembly 10 toward the midline of the container ladder 100 during operation. In such an embodiment, the arm 50 may be provided without apertures. It is further contemplated that the first member 12 of the assembly 10 may also include an arm 50, locking member 52 or clamp as described above.

Still referring to FIGS. 6A and 6B, the second member 13 may also include one or more handles 55 for ease of transport and/or controlling the assembly 10 during use. Without limiting the handle 55 to a particular configuration, a suitable handle 55 is configured for ease of being latched onto, grabbed or otherwise held by hand. Likewise, the first member 12 may also include one or more handles 55 as desired (see FIGS. 3A-3C).

Figure 7:
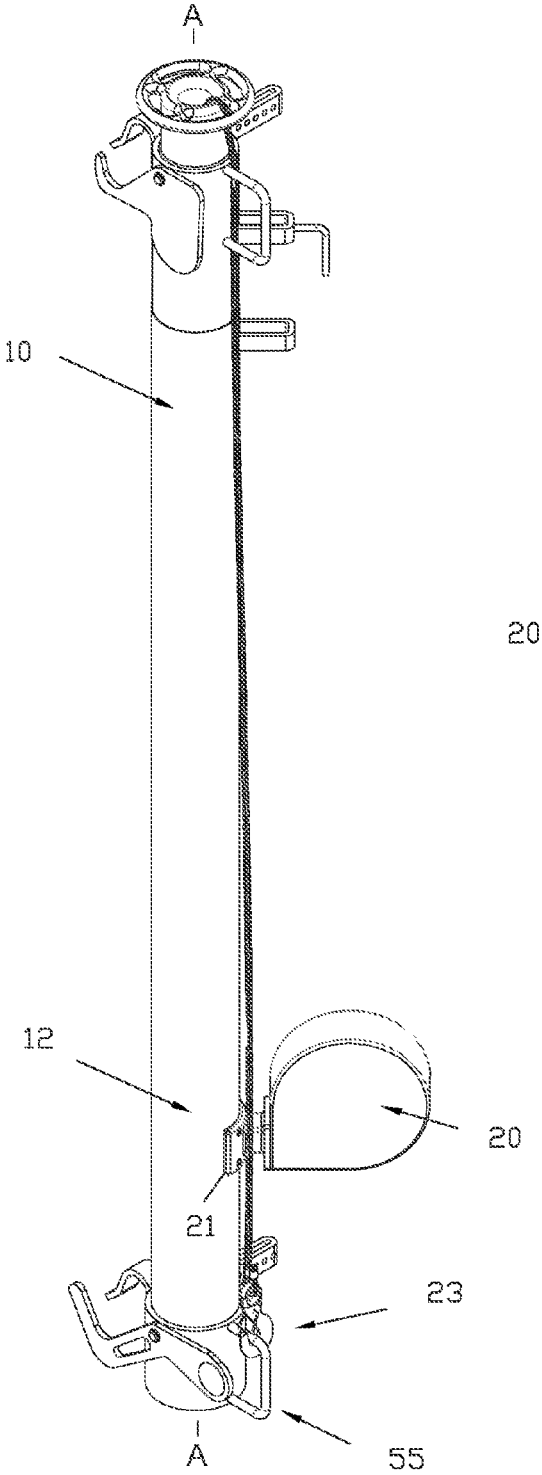
FIG. 7 is a perspective view of a fall arrest ladder assist assembly.
Figure 8:
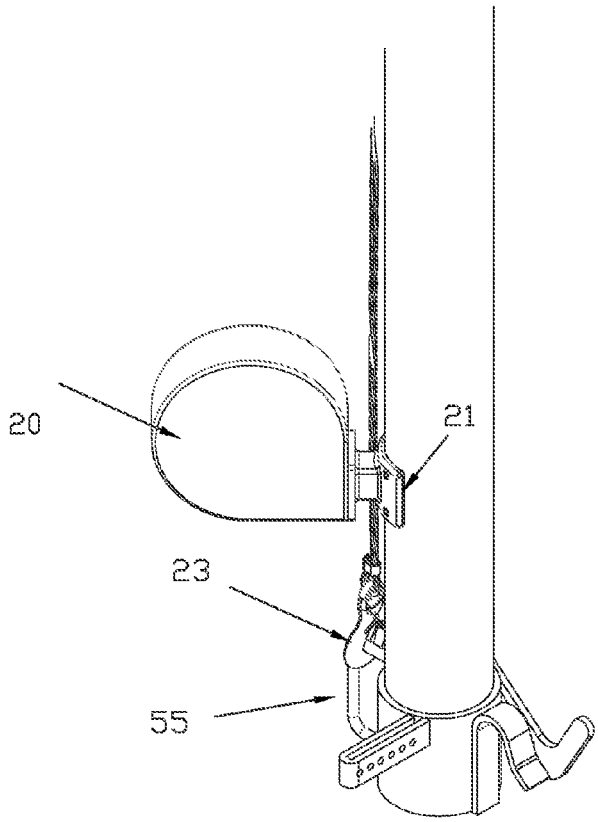
FIG. 8 is a detailed view of a retractable reel of the fall arrest ladder assist assembly of FIG. 7.

Turning to FIGS. 7 and 8, the reel 20 may include an open mouth configuration for a lifeline 22 releasably attachable to the outer surface of the first member 12. As depicted in FIGS. 7 and 8, the lifeline 22 mouth of the reel 20 may include a faceplate 21 releasably attachable to the first member 12 via one or more fasteners including, but not necessarily limited to bolts, screws, nails, pins, and combinations thereof. In another embodiment including a reel 20 having a metal housing, the reel 20 may be welded to the first member 12 along the perimeter of its open mouth. The faceplate 21 may also be chemically adhered to the first member 12 in one or more implementations. Regardless the mode of attachment, the lifeline mouth of the reel 20 is suitably aligned in communication with an opening along the first member 12, the opening of the first member 12 being large enough to allow the lifeline 22 to travel from the reel 20 through the first member 12 unencumbered and free from snags and the like. In particular, the mating between the mouth of the reel 20 and the corresponding first member 12 are aligned in a manner effective to allow a lifeline 22 to bend up to about 90.0 degrees unencumbered as the lifeline 22 extends and retracts between the reel 20 and internal pathway of the first member 12.

Figure 9A:
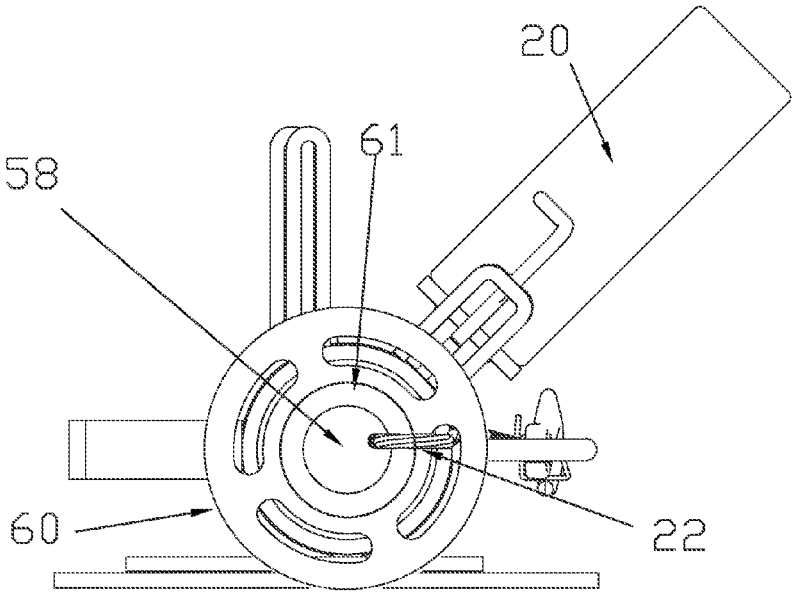
FIG. 9A is a view of the distal end of the third member of a fall arrest ladder assist assembly.
Figure 9B:
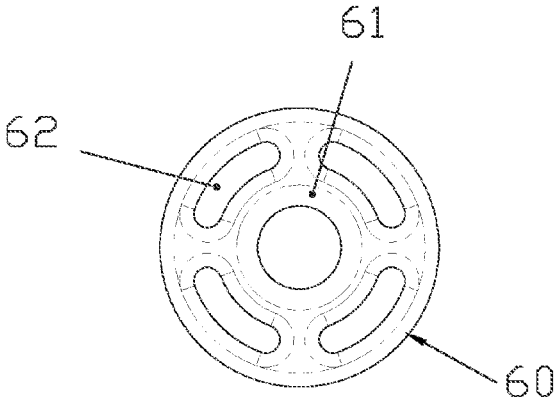
FIG. 9B is a view of a redirection surface member of the distal end of the third member of FIG. 9A.
Figure 9C:
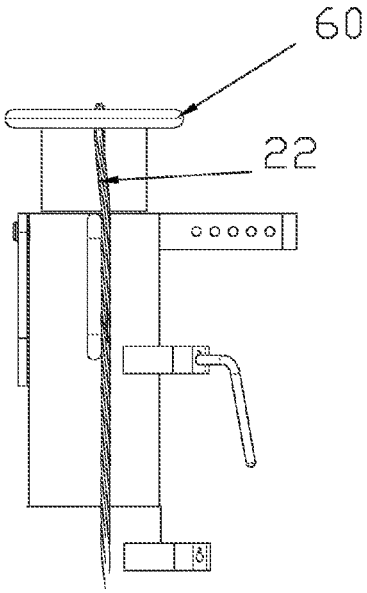
FIG. 9C is a side view of the distal end of the third member of FIG. 9A.
Figure 10A:
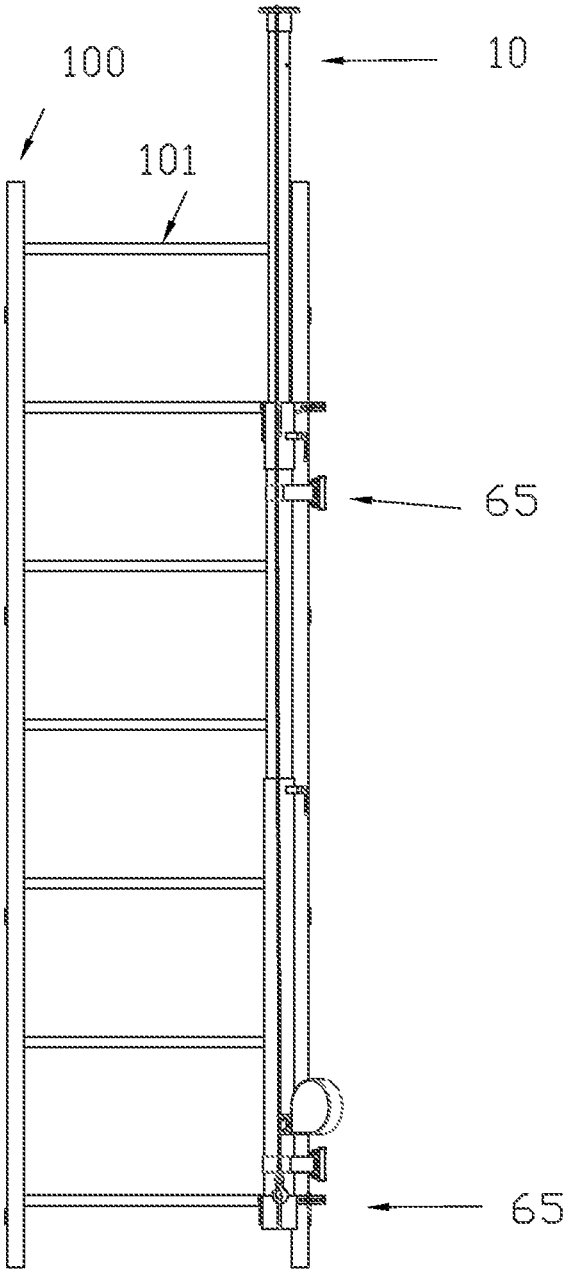
FIG. 10A is a front view of a fall arrest ladder assist assembly secured to a ladder of a transportation container.
Figure 10B:
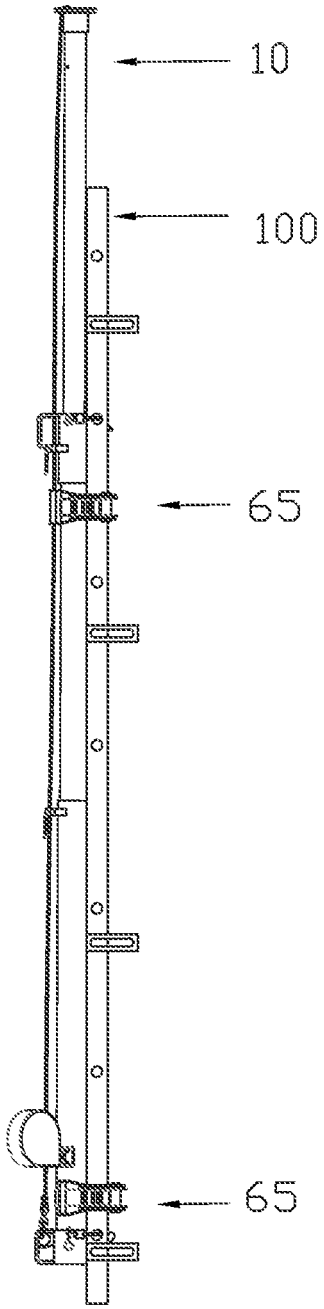
FIG. 10B is a left side view of the fall arrest ladder assist assembly and ladder of FIG. 10A.
Figure 10C:
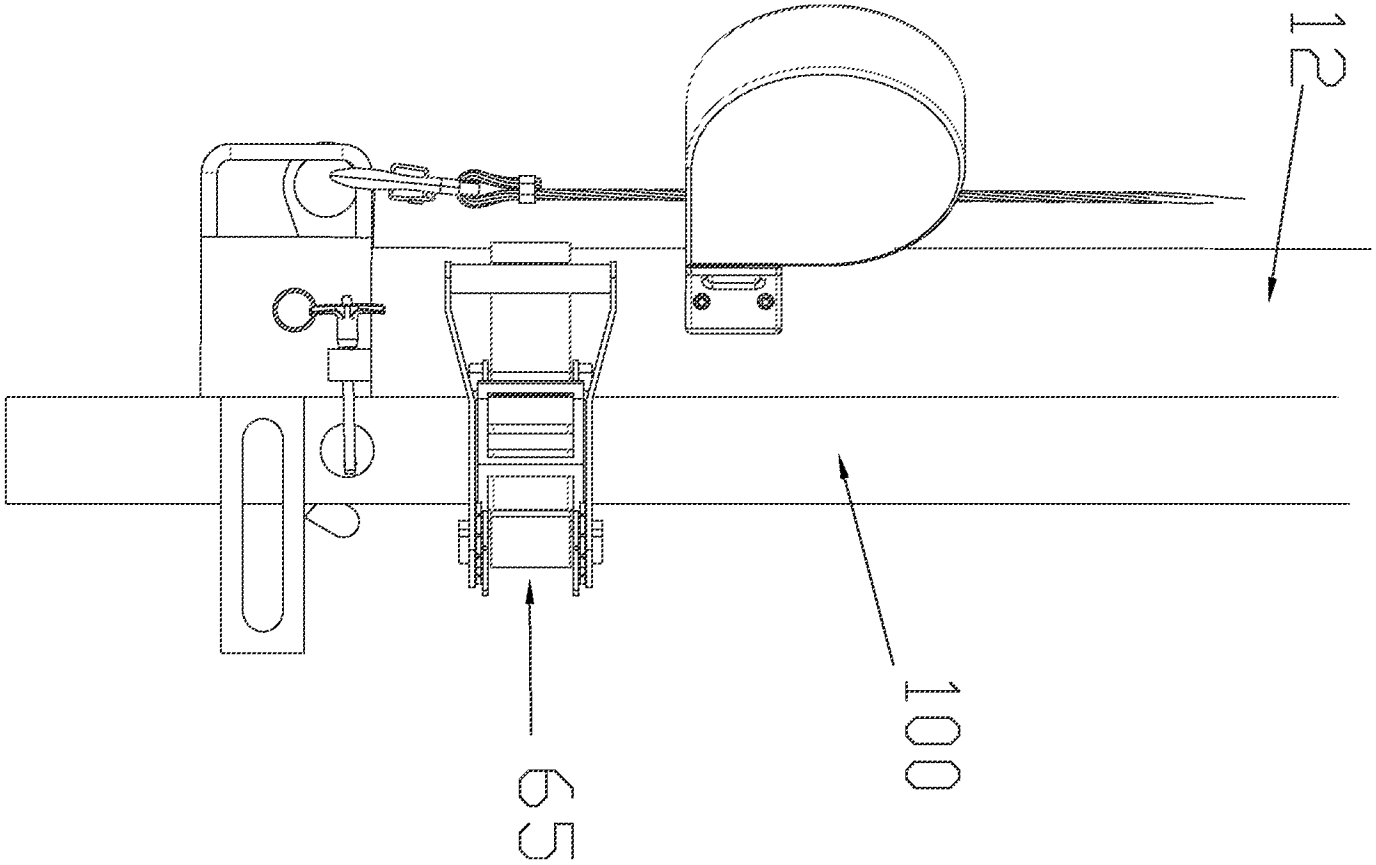
FIG. 10C is a detailed view of the secondary attachment of FIG. 10B.
Figure 10D:
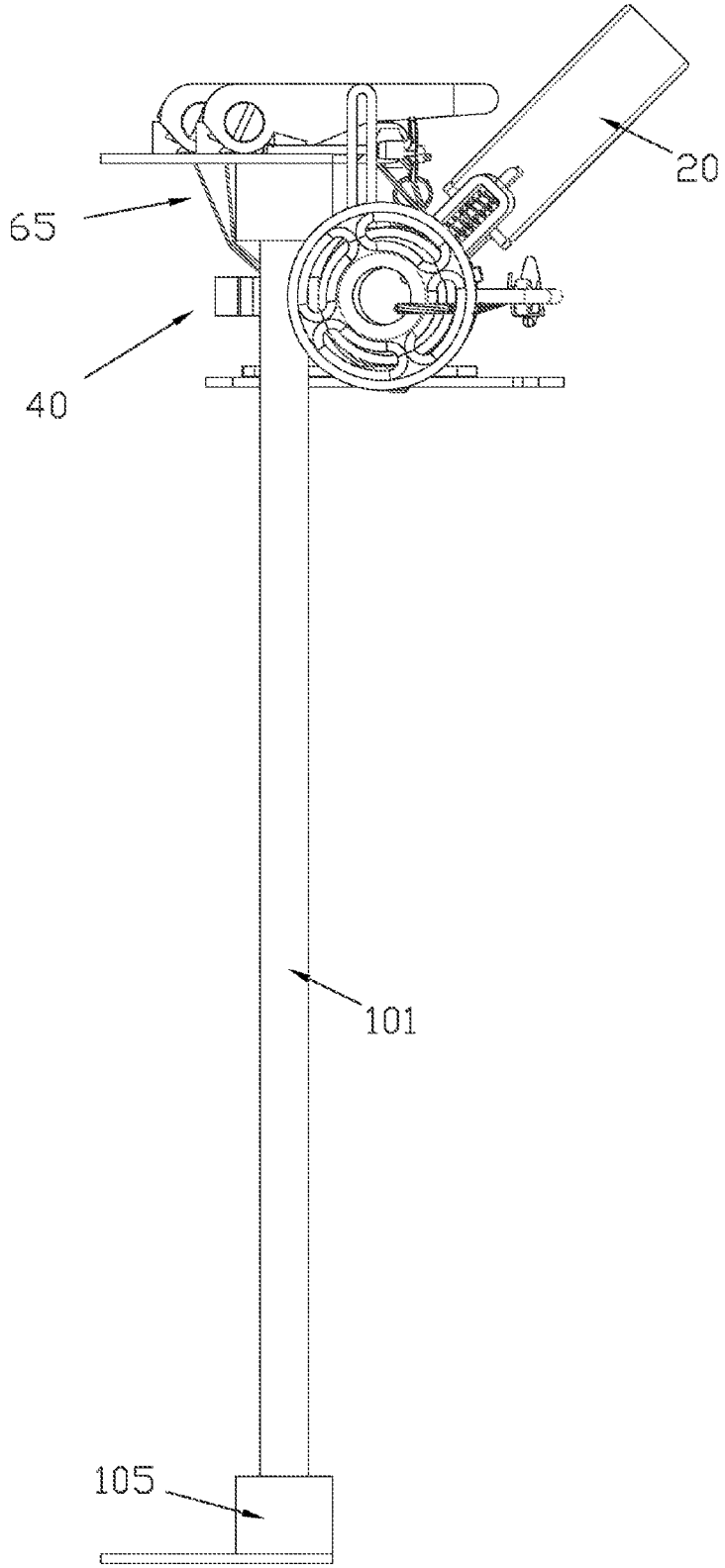
FIG. 10D is a top view of the fall arrest ladder assist assembly and ladder of FIGS. 10A and 10B.

Suitably, the lifeline 22 runs through the internal pathway of the assembly 10, i.e., through internal pathways of the members 12, 13 and 14, in a manner effective to protect the lifeline 22 from undesired contact from one or more external sources. As stated above, the distal end of the third member 14 may be operationally configured as a support surface of a lifeline 22 at its bending point as the lifeline 22 exits from within the third member 14. Referring to FIGS. 9A-9C, one particular distal end of the third member 14 may include a redirection surface member 60 for supporting a lifeline 22 at its bending point. As shown, the redirection surface member 60 suitably includes an open mouth 58 in communication with the internal pathway of the assembly 10, the mouth 58 being defined by a circular rounded surface 61 for promoting desired travel of the lifeline 22 upon the rounded surface 61. Without limiting the invention to a particular embodiment or particular configuration, a suitable redirection surface member 60 includes a central mouth 58 aligned according to the central axis A-A of the assembly 10 and one or more radial apertures 62. In the embodiment of FIGS. 9A-9C, the redirection surface member 60 is operationally configured to provide a bending surface for a lifeline 22 up to about 180.0 degrees in relation to the central axis A-A of the assembly 10. In another embodiment, the one or more apertures 62 are operationally configured to maintain the lifeline 22 in a bent orientation about the redirection surface member 60 from about 30.0 degrees to about 180.0 degrees. In addition, the one or more apertures 62 are operationally configured to maintain the radial direction of a lifeline 22 in relation to the central axis A-A of the assembly 10 as desired.

As shown in FIG. 7, with the assembly 10 in a storable retracted position, a connector 23 attached to the distal end of a lifeline 22 may be secured to the handle 55 on the first member 12 in a manner effective to remove slack and maintain the lifeline 22 in a substantially secured position near the outer surface of the assembly 10 preventing undesired movement of the lifeline 22. In another embodiment, a connector 23 may be attached to another handle disposed along either the second or third members 12, 13. As understood by the skilled artisan, the reel 20 may be maneuvered in a manner effective to remove any slack from the lifeline 22 to best secure the lifeline as shown in FIG. 7.

As desired, the assembly 10 may also include one or more secondary attachments 65 for further releasable securement of the assembly 10 to a ladder 100. In one simplified implementation the secondary attachments 65 may include rope, plastic ties, tape, and combinations thereof for securing the first and second members 12, 13 to a ladder 100. As shown in FIGS. 10A-10D, secondary attachments 65 may include strap(s) operationally configured to be wrapped around the assembly 10 and ladder 100 for securing the assembly 10 to the ladder 100 preventing horizontal movement of the assembly 10 relative a ladder 100 during use. Without limiting the invention, straps may be held in place via buckles, latches, hook/loop type fasteners, and combinations thereof.

Figure 12:
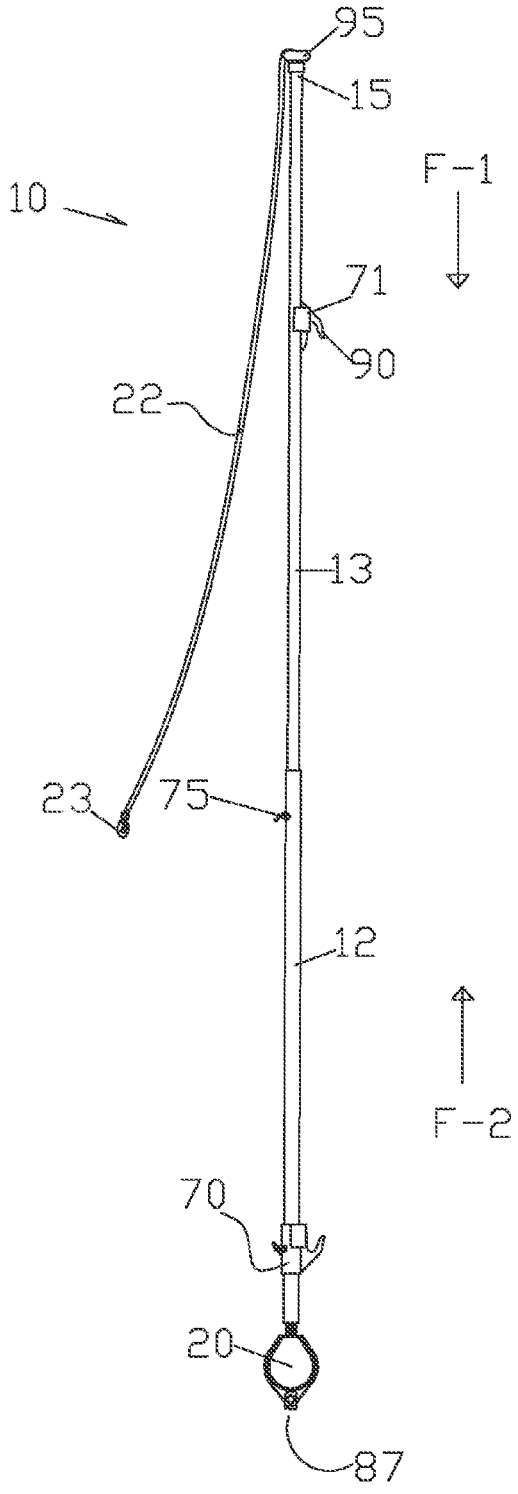
FIG. 12 is a simplified illustration of an embodiment of a fall arrest ladder assist assembly of the present application
Figure 13:
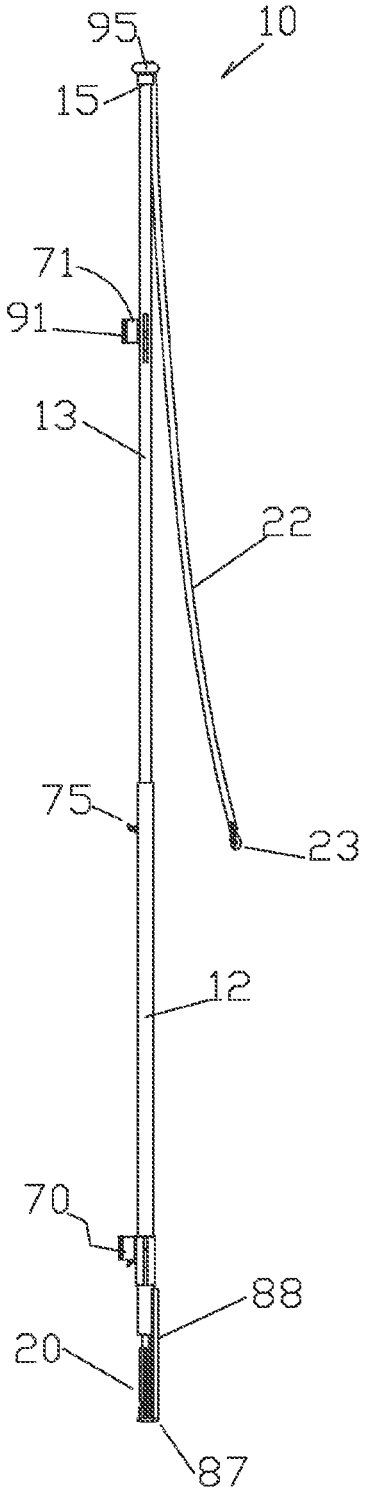
FIG. 13 is another view of the fall arrest ladder assist of FIG. 12.

In another embodiment as shown in FIGS. 12 and 13, the assembly 10 may be provided as a two member assembly including at least a first member 12 and a second member 13 coaxially aligned in a telescoping manner. Suitably, the assembly 10 is operationally configured to extend out to a desired length according to (a) one or more particular assembly 10 applications, (b) the size of one or more target structures and/or (c) the length of ladders affixed to such structures. The assembly 10 may also be configured to retract to an overall length slightly greater than the length of the first member 12, e.g., up to about 30.0% greater in length than the length of the first section 12. As shown, the first member 12 includes an opening there through with an inner diameter or width greater than the outer diameter or width of a corresponding second member 13, which is operationally configured to telescope in and out from the first member 12 allowing the assembly 10 to be set at an elongated position for operation by fixing the position of the second member 13 in relation to the first member 12 via one or more fasteners 75, e.g., a locking pin, a locking screw such as a winged screw, a T-bolt fastener, and the like, and combinations thereof. It is also contemplated that the distal end of the first member 12 and the proximal end of the second member 13 include corresponding lips or the like whereby the second member 13 may hang freely within the first member 12 at a maximum length of the assembly 10.

In railcar applications whereby the distal end of a ladder 100 ends at about the top 102 of a railcar 500, the distal end of the second member 13 is suitably set at least about 0.91 meters (about 3.0 feet) above the top 102 of the corresponding railcar 500 whereby the fall arrest system is operationally configured to minimize the travel distance of an individual's accidental fall to about 0.61 meters (about 2.0 feet) or less. In one particularly advantageous embodiment, the fall arrest may be operationally configured to minimize the distance of a person's fall up to about 5.08 cm (about 2.0 inches).

In an embodiment where the distal end of a ladder 100 is set below the top 102, the second member 13 may be increased in length to ensure that that distal end of the second member 500 rises above the top 102 a desired distance, including the above cited exemplary distance. In an embodiment where the distal end of a ladder 100 is set above the top 102, the second member 13 may be decreased in length to ensure that that distal end of the second member 500 rises above the top 102 a desired distance, including the above cited exemplary distance. Without limiting the invention, in one suitable embodiment about one-third the length of the assembly 10 of this application extends above the distal end of the corresponding ladder 100.

Suitably, the assembly 10 of this embodiment includes one or more ladder attachments for releasably engaging a ladder 100 to secure the assembly 10 to a ladder 100. For example, the assembly 10 may include a first attachment assembly 70 disposed along the first member 12 and a second attachment assembly 71 disposed along the second member 13. Similar as the embodiments described above, this embodiment of the assembly 10 also includes a fall arrest system in the form of a self-retractable lifeline, i.e., a retractable reel 20, lifeline 22 and connector 23. As such, the assembly 10 suitably secures to a ladder 100, e.g., a container ladder, in a manner effective to anchor or otherwise support a user 5 of the assembly 10 during access and egress.

Still referring to FIGS. 12 and 13, the retractable reel 20 of this embodiment is suitably attached at the proximal end of the first member 12, whereby the lifeline 22 runs from the retractable reel 20 into the proximal end of the first member 12. In particular, the lifeline 22 runs out of the mouth of the reel 20 through the first and second members 12, 13 and out the distal end 15 of the second member 13 as shown—the mouth of the reel 20 being in-line, along central axis A-A, with the opening of the proximal end of the first member 12. In another embodiment, the retractable reel 20 may be attached at another point along the assembly 10 and/or the lifeline 22 may have a different point of entry into the first member 12 similar as the embodiments discussed above. In still another embodiment, the lifeline 22 may be disposed outside of the first and second members 12, 13 altogether.

In this embodiment, the second attachment assembly 71 suitably engages a rung of a ladder 100 in a suspending type manner via gravity (a first applied force F-1). In order to prevent vertical movement of the assembly 10 upward, the first attachment assembly 70 is suitably moveable along the first member 12 and may be directed to a contact position with the underside of a target ladder rung in a manner effective to provide an opposing second applied force F-2 to the ladder 100 during assembly 10 operation. As such, the first and second attachment assemblies 70, 71 are operationally configured to provide opposing gripping type attachments along different rungs of a ladder 100. Without limiting the points of engagement of this particular embodiment, in one embodiment the first attachment assembly 70 suitably engages the lowermost rung of a ladder 100 and the second attachment assembly 71 suitably engages the uppermost rung of the ladder 100.

Figure 15:
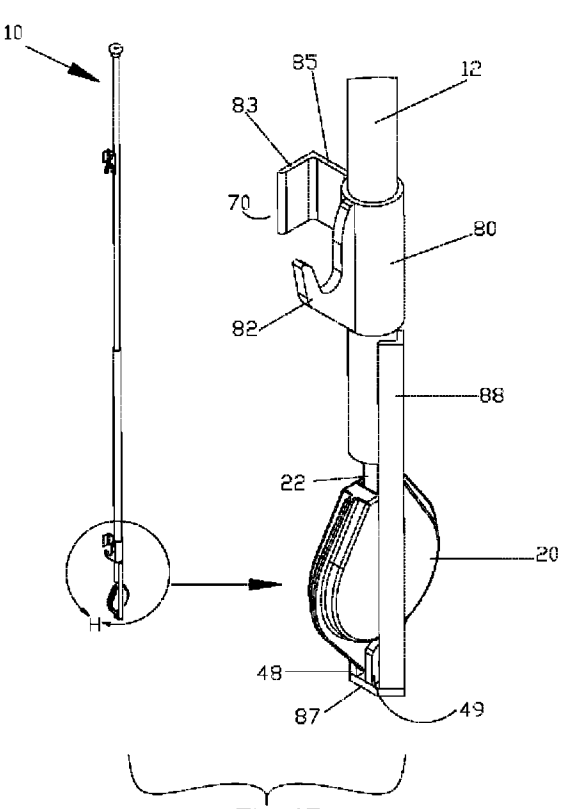
FIG. 15 is another detailed side view of the proximal end of the fall arrest ladder assist of FIG. 12.
Figure 14:
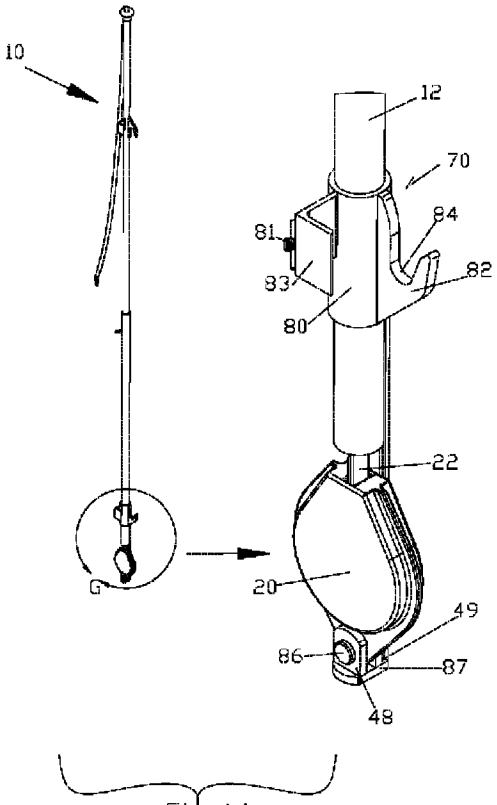
FIG. 14 is a detailed side view of a proximal end of the fall arrest ladder assist of FIG. 12.

Turning to FIGS. 14 and 15, including details G and H of the first attachment assembly 70, the first attachment assembly 70 suitably includes a moveable member in the form of a collar 80 moveably secured to the first member 12 and operationally configured to be adjusted along the length of the first member 12 via a corresponding locking member 81 received there through. Without limiting the invention, in one embodiment the first member 12 may include a plurality of apertures there through for receiving a release pin type locking member 81 for fixing the first attachment assembly 70 in a plurality of locations along the first member 12. In another embodiment, the locking member 81 may include a screw type member operationally configured to be received through an aperture 79 of the collar 80 and tightened against the outer surface of the first member 12 at a maximum number of locations along the first member 12 as desired or as otherwise required according to the size and type of target ladder 100 to which the assembly 10 is being attached.

Figure 17:
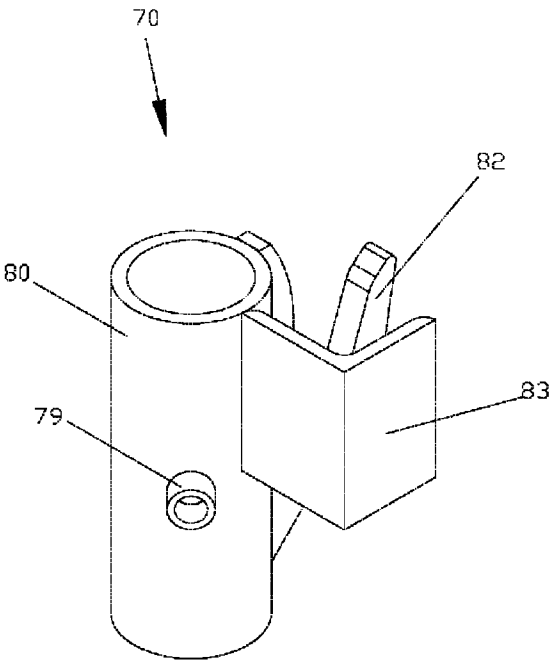
FIG. 17 is another perspective view of the first attachment assembly of the fall arrest ladder assist of FIG. 12.
Figure 16:
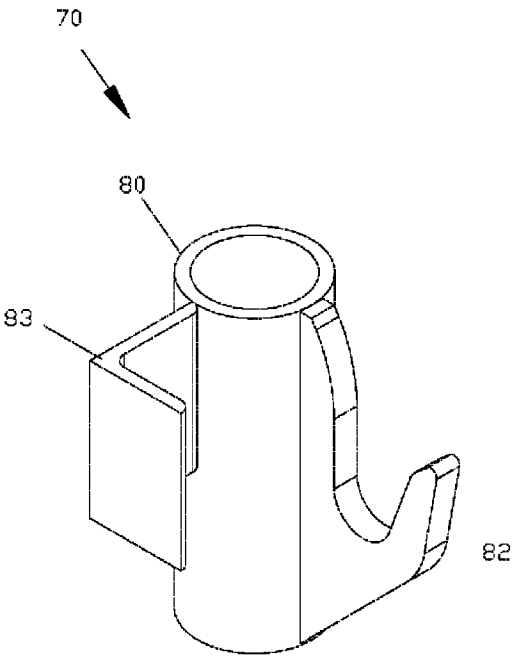
FIG. 16 is a perspective view of the first attachment assembly of the fall arrest ladder assist of FIG. 12.

In this embodiment, the first attachment assembly 70 also suitably includes (1) a first hook member 82 extending out from the collar 80 in a manner effective to engage a ladder rung 101 to prevent or minimize upward movement of the first attachment assembly 70 and the whole assembly 10 during operation and (2) a lateral member in the form of a first bracket 83 extending out from the collar 80 in a manner effective to contact a ladder frame 105 to prevent or minimize horizontal movement of the assembly 10 toward the midline of the container ladder 100 during operation. An exemplary first attachment assembly 70 is depicted in FIGS. 16 and 17.

As shown, the first hook member 82 suitably includes an upright hook member having a "J" type configuration wherein its contact surface 84 is operationally configured to substantially correspond to the outer surface configuration of a corresponding ladder rung—which is commonly cylindrical in relation to most container ladders 100 but also may include a multi-side configuration. In addition, the width of the first hook member 82 may vary as desired, however the first hook member 82 suitably includes a width for providing stability and/or strength to the assembly 10 during use. Likewise, the first hook member 82 suitably includes a length great enough so that the distal end of the first hook member 82 is located at an altitude greater than or equal to the corresponding ladder rung in a manner effective to guard against the first hook member 82 slipping off in a horizontal direction away from the corresponding ladder rung during assembly 10 operation. As stated above, a common rung 101 of a container ladder 100 has a diameter of about 2.54 cm (about 1.0 inches). As such, one suitable first hook member 82 may include a "J" type configuration including a distal end of its contact surface 84 extending out to about 10.16 cm (about 4.0 inches) from its central turning point.

As shown, the first bracket 83 suitably extends out from the collar 80 about ninety degrees relative to the first hook member 82. The first bracket 83 suitably includes a bend or curve operationally configured to extend around a ladder frame 105 to prevent or minimize horizontal movement of the assembly 10 toward the midline of the container ladder 100 during operation. In this particular embodiment, the first bracket 83 is provided as an "L bracket," as the term is understood by the skilled artisan, operationally configured to contact the right side frame member of a ladder frame 105. In operation, the assembly 10 may be oriented in a manner whereby the first bracket 83 abuts or otherwise contacts the outside surface of the corresponding ladder frame 105. As such, the first section 85 of the first bracket 83 includes a length greater than the width of the corresponding ladder frame 105.

Without limiting the invention to particular embodiments, the first hook member 82 and first bracket 83 may be attached to the collar 80 as desired or as required according to the one or more materials of construction of such component parts. For example, the first hook member 82 and first bracket may be secured to the collar 80 via one or more fasteners. The first hook member 82 and first bracket may be adhered to the collar 80. In an embodiment including metal materials of construction, the first hook member 82 and first bracket may be welded to the collar 80. In another embodiment, the first attachment assembly 70 may be provided as a one piece member constructed from a mold.

Figure 18B:
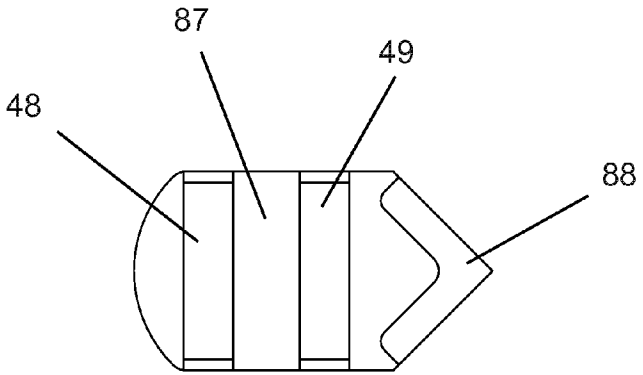
FIG. 18B is a top view of the coupling assembly of FIG. 18A.
Figure 18A:
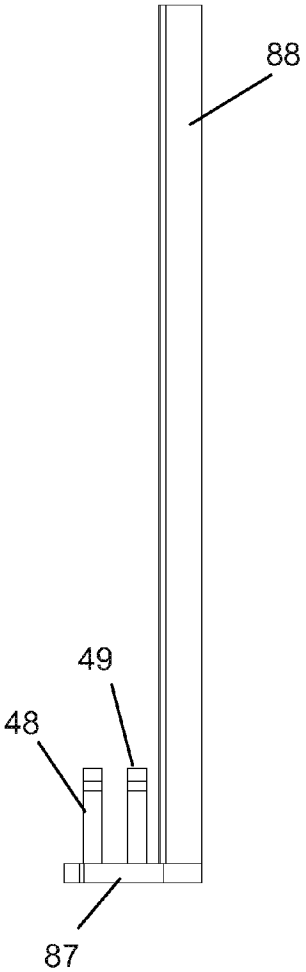
FIG. 18A is a side elevational view of a coupling assembly of the fall arrest ladder assist of FIG. 12.

Still referring to FIGS. 14 and 15, the retractable reel 20 is secured to the first member 12 in what may be referred to as an "in-line" arrangement as opposed to an offset arrangement as shown in FIG. 7. As shown, the reel 20 may be secured to the assembly 10 whereby the mouth of the reel 20 is set apart from the proximal end of the first member 12 a distance exposing part of the lifeline 22 extending out from the mouth of the reel 20 into the interior of the first member 12. Without limiting attachment of the reel 20 to the first member 12 to any one particular configuration, it may be advantageous to maintain the reel 20 in a static state when attached to the first member 12. For example, in the embodiment as shown in FIGS. 14 and 15, a coupling assembly may be provided for attaching the reel 20 to the first member 12. In this embodiment, the coupling assembly includes opposing pillow block members 48 and 49, or the like, disposed on either side of the connection eye of the reel 20 and operationally configured to receive a fastener 86, e.g., a pin, there through. The coupling assembly also includes a bottom plate member 87 for attachment of the pillow block members 48, 49 and for providing an attachment platform for a linking member 88, which is operationally configured to attach to the first member 12 for securing the reel 20 during assembly 10 operation. In one embodiment comprising metal components, the linking member 88 may be provided as an elongated member, e.g., flat beam material, angle beam material, welded to the first member 12 and to the bottom plate member 87. An exemplary coupling assembly is depicted in FIGS. 18A and 18B.

Figures 19A, 19B, 19C, 19D:
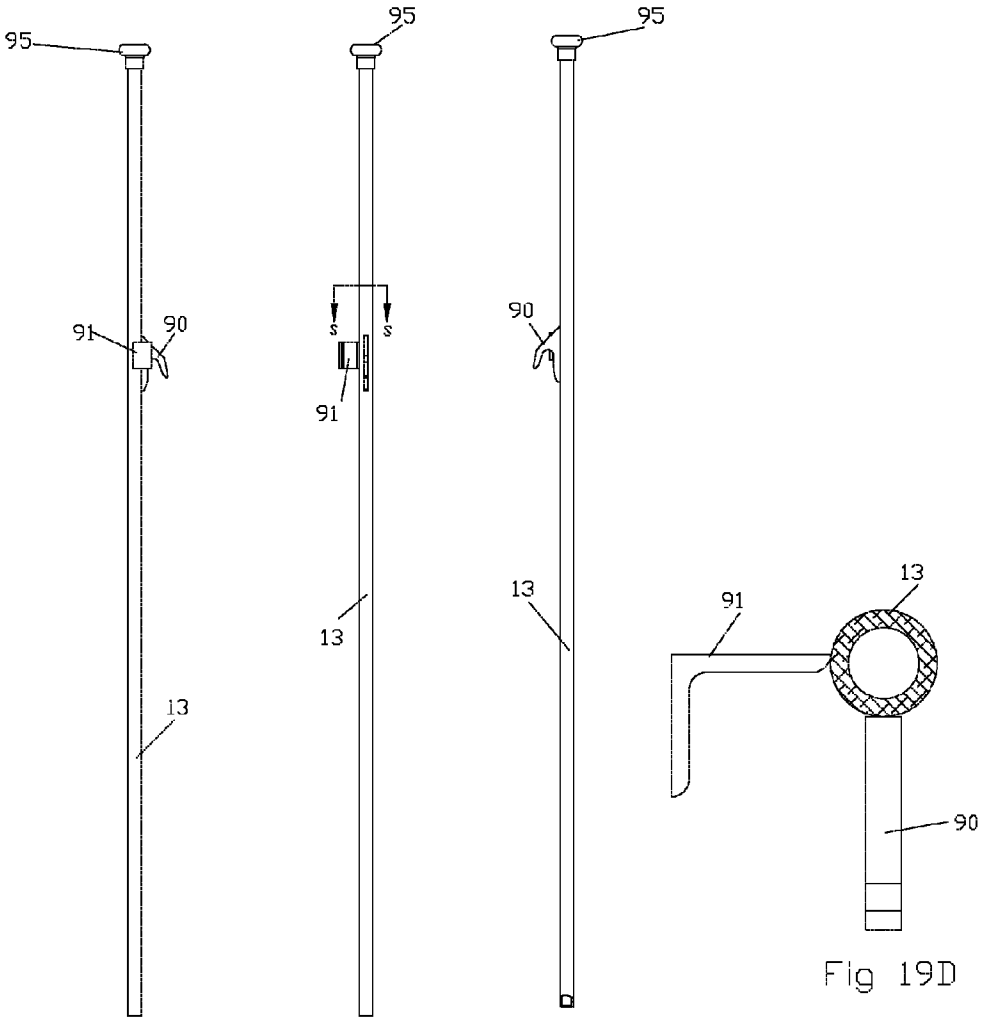
FIG. 19A is an elevational side view of a second member of the fall arrest ladder assist of FIG. 12.
FIG. 19B is another side view of the second member of FIG. 19A.
FIG. 19C is another side view of the second member of FIG. 19A.
FIG. 19D is a sectional view S-S of FIG. 19B.

Referring to the simplified illustrations of FIGS. 19A-19D, the second attachment assembly 71 suitably includes a second hook member 90 and a lateral member in the form of a second bracket 91 extending out from the outer surface of the second member 13 in a fixed position. The second hook member 90 suitably includes an inverted hook member operationally configured to engage or otherwise rest atop a ladder rung 101 to prevent or minimize downward vertical movement of the assembly 10 during operation. As shown in FIG. 19D, the second bracket 91 is operationally configured to extend out from the second member 13 about ninety degrees relative the second hook member 90 in a manner effective to contact a ladder frame 105 to prevent or minimize horizontal movement of the assembly 10 toward the midline of the container ladder 100 during operation. As shown, the second hook member 90 suitably includes an upside down "J" type configuration wherein the contact surface of the second hook member 90 is configured to substantially correspond to the outer surface configuration of a ladder rung. A suitable second hook member 40 includes a "J" type configuration with a contact surface extending out to about 10.16 cm (about 4.0 inches) from its central turning point.

Figure 20:
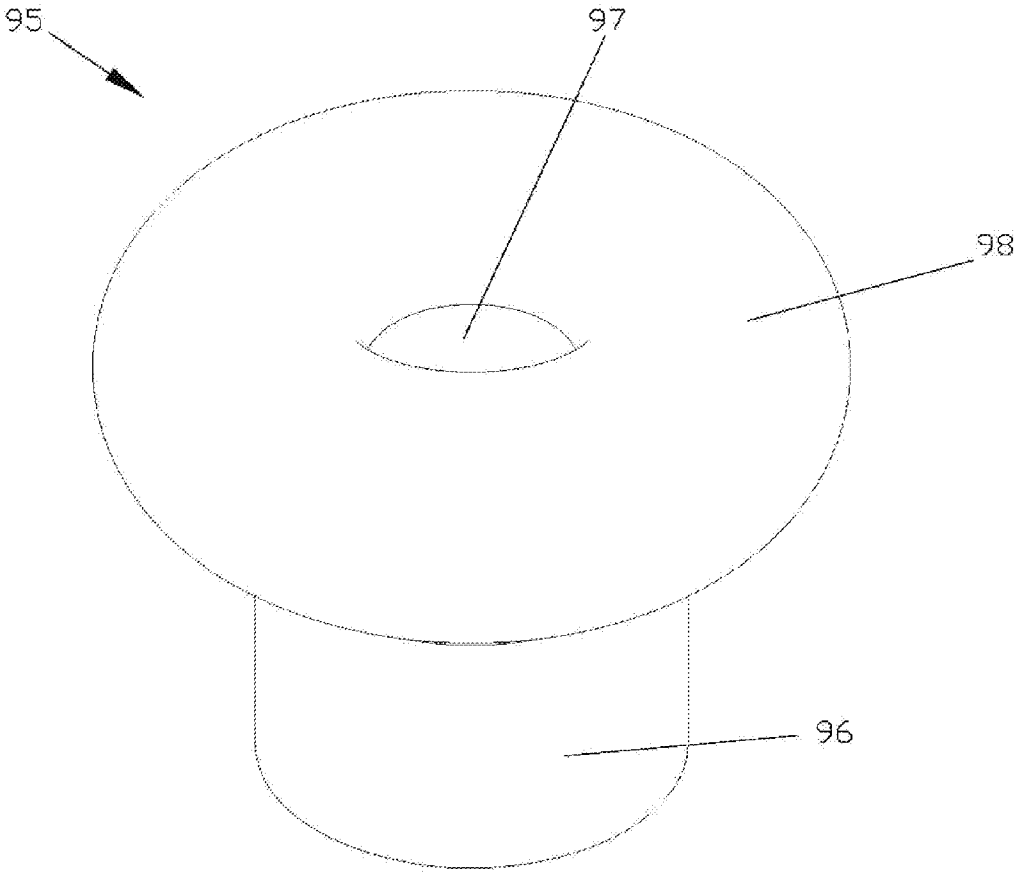
FIG. 20 is a perspective view of a redirection surface member of the fall arrest ladder assist of FIG. 12.

The distal end 15 of the second member 13 suitably includes a redirection surface member 95 for supporting a lifeline 22 at its bending point. As shown in FIG. 20, the redirection surface member 95 suitably includes a doughnut type configuration member 98 with a circular rounded surface and a neck member 96 (or "neck") for mating with the distal end of the second member 13. The redirection surface member 95 is further defined by an open mouth 97 there through, the mouth 97 being in communication with the internal pathway of the assembly 10. Suitably, the circular rounded surface of the doughnut type configuration member 98 is effective to promote desired travel of the lifeline 22 upon the surface the doughnut type configuration member 98.

In one embodiment, the mouth 97 of the redirection surface member 95 may be aligned according to the central axis A-A of the assembly 10. Also, the neck 96 may be operationally configured as a male member or as a female member for mating with a distal end of the second member 13 in an overlapping manner as desired. In another embodiment, the distal end of the neck 96 may be fastened to the distal end of the second member 13. In another embodiment, the redirection surface member 95 may be provided without a neck 96 whereby the doughnut type configuration member 98 may be fastened to the distal end of the second member 13.

Similar as described above, the embodiment of FIGS. 12-13 may also include one or more handles 55 and one or more secondary attachments 65 as desired.

During operation with a transportation carrier 500, a user 5 may extend the second member 13 out to a desired distance in relation to the first member 12 necessary for the assembly 10 to extend above the top 102 of the carrier 500 during use. Once a desired length of the assembly 10 is realized the first and second members 12, 13 may be set to a fixed position via the fastener 75. Next, the second hook member 90 may be set atop an uppermost ladder rung 101 of a fixed ladder 100 of the carrier 500 whereby the assembly 10 may hang freely in vertical alignment with the fixed ladder 100 with the distal ends of the first and second brackets 83, 91 set outside the right ladder frame 105. This may be accomplished with the user 5 located on the ground or surface without having to step onto the ladder 100. In the alternative, the second hook member 90 may be set atop an uppermost ladder rung 101 of a fixed ladder 100 of the carrier 500 prior to setting the first and second members 12, 13 to a fixed position via the fastener 75.

Once the second hook member 90 is set atop the uppermost ladder rung, the user 5 may then adjust the first attachment assembly 70 by directing the collar 80 upward along the first member 12 until the first hook member 82 abuts the lowermost ladder rung of the fixed ladder 100 as desired. The locking member 81 may then be manipulated to a locked position to maintain the collar 80 and first hook member 82 in a fixed position relative the first member 12. In operation, the first and second hook members 82, 90 and the first and second brackets 83, 91 are operationally configured to prevent movement of the first and second members 12, 13 directionally along three axes relative the ladder 100, i.e., to prevent up and down movement of the first and second members 12, 13 along a vertical axis; to prevent side to side lateral movement of the first and second members 12, 13 along a horizontal axis and to prevent the first and second members 12, 13 from pulling away off from the ladder 100 along a third axis perpendicular to the first two axes.

Once the assembly 10 is fixed to the ladder 100, the user 5 may attach himself/herself to the lifeline 22 via the connector 23 and access the top 102 of the carrier 500. Suitably the lifeline 22 is long enough to allow a user to travel across the whole distance of the top 102 of the carrier 500 when tethered to the lifeline 22. When descending from the top 102 of the carrier 500, a user 5 may use the portion of the second member 13 extending above the top 102 of the carrier 500 as a handhold or to otherwise steady himself/herself when stepping onto the ladder 100. Once egress is accomplished the first attachment assembly 70 may be loosened from the first member 12 and the assembly 10 may be lifted off from the ladder 100 for transport, reuse or storage.

At a minimum, the assembly 10 may be constructed from one or more materials effective to support an individual during a slip or fall when using the assembly 10. As such, one suitable assembly 10 may be constructed from one or more materials effective to hold up to about 136.1 kg (about 300.0 pounds).

Suitable assembly 10 materials of construction may include, but are not necessarily limited to those materials resistant to chipping, cracking, excessive bending and reshaping as a result of ozone, weathering, heat, moisture, other outside mechanical and chemical influences, as well as various impacts and other loads placed on the assembly 10. Likewise, the assembly 10 may comprise any color or combination of colors. In addition, the assembly 10 may include one or more outer coatings effective to protect the construction materials from one or snore the outside influences listed above. Suitable materials of construction may include, but are not necessarily limited to metals, plastics, rubbers, woods, composite materials, and combinations thereof. Suitable plastics include, but are not necessarily limited to vinyl polymers and polyvinyl chloride (PVC), and combinations thereof. Suitable metals include, but are not necessarily limited to aluminum, steel, titanium, and combinations thereof.

The invention will be better understood with reference to the following non-limiting examples, which are illustrative only and not intended to limit the present invention to a particular embodiment.

EXAMPLE 1

In a first non-limiting example, an assembly 10 as shown in FIG. 2A is provided, the assembly 10 main frame component parts being constructed from aluminum and the assembly 10 having the following parameters:

(1) Retractable Main Frame (First, Second and Third Members 12, 13 and 14)

First Member 12: Outer Diameter: about 9.70 cm (about 3.80 inches)
Inner Diameter: about 8.40 cm (about 3.30 inches)
Length: about 1.52 m (about 5.0 feet)

Second Member 13: Outer Diameter: about 7.90 cm (about 3.10 inches)
Inner Diameter: about 6.60 cm (about 2.60 inches)
Length: about 1.52 m (about 5.0 feet)

Third Member 14: Outer Diameter: about 6.35 cm (about 2.50 inches)
Inner Diameter: about 5.10 cm (about 2.0 inches)
Length: about 1.52 m (about 5.0 feet)

(2) Lifeline 22: Length: about 5.49 m (about 18.0 feet)
Material of Construction: Galvanized Steel
Maximum Arresting Force: up to about 2268.0 kg (about 5000.0 pounds)

(3) First and Second Hook Members 30, 40:
Length: about 10.2 cm (about 4.0 inches)
Width: about 1.3 cm (about 0.50 inches)
Material of Construction: Aluminum (4) Second Keeper 42: Material of Construction: Aluminum (5) Connector 23: Stainless Steel Snap Hook

EXAMPLE 2

In a second non-limiting example, an assembly 10 as shown in FIG. 12 is provided, the assembly 10 main frame component parts being constructed from aluminum and the assembly 10 having the following parameters:

(1) Retractable Main Frame (First and Second Members 12 and 13)

First Member 12: Outer Diameter: about 5.08 cm (about 2.0 inches)
Inner Diameter: about 3.81 cm (about 1.50 inches)
Length: about 1.83 m (about 6.0 feet)

Figure 22:
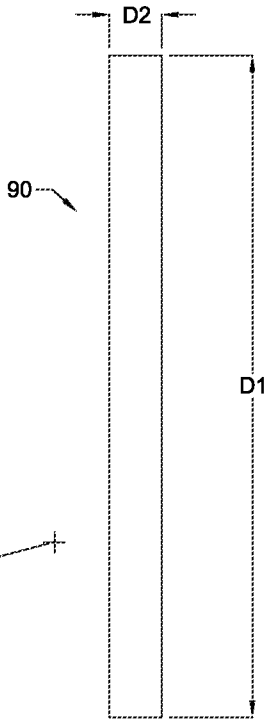
FIG. 22 is a back view of the second hook member of FIG. 21.
Figure 21:
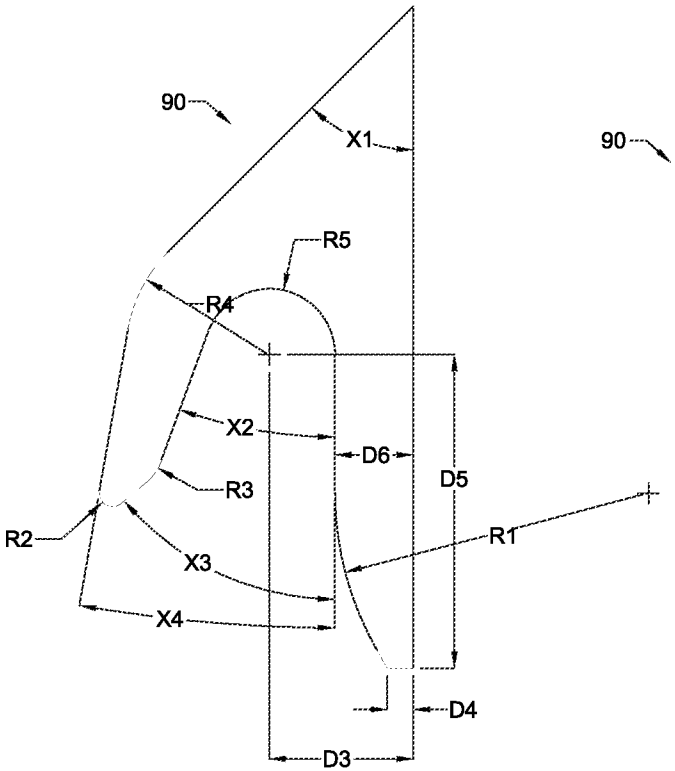
FIG. 21 is a side view of a second hook member of the fall arrest ladder assist of FIG. 12.

Second Member 13: Outer Diameter: about 3.81 cm (about 1.50 inches)
Inner Diameter: about 2.54 cm (about 1.0 inches)
Length: about 2.74 m (about 9.0 feet)
Maximum Length (Assembled): about 3.06 m (about 120.5 inches)
(2) Lifeline 22: Length: about 5.49 m (about 18.0 feet)
Material of Construction: Galvanized Steel
Maximum Arresting Force: up to about 2268.0 kg (about 5000.0 pounds)
(3) First and Second Hook Members 82, 90 (FIGS. 21 and 22):
Material of Construction: Aluminum
D1: about 16.03 cm (about 6.31 inches)
D2: about 1.27 cm (about 0.50 inches)
D3: about 3.51 cm (about 1.38 inches)
D4: about 0.64 cm (about 0.25 inches)
D5: about 7.62 cm (about 3.0 inches)
D6: about 1.91 cm (about 0.75 inches)
R1: about 7.62 cm (about 3.0 inches)
R2: about 0.32 cm (about 0.125 inches)
R3: about 1.27 cm (about 0.50 inches)
R4: about 3.51 cm (about 1.38 inches)
R5: about 1.6 cm (about 0.63 inches)
X1: about forty-five degrees) (45.0°)
X2: about twenty degrees) (20.0°)
X3: about fifty degrees) (50.0°)
X4: about ten degrees) (10.0°)
(4) Connector 23: Stainless Steel Snap Hook
(5) Coupling Assembly
Bottom Plate Member 87: Length: about 6.86 cm (about 2.7 inches)
Width: about 3.81 cm (about 1.5 inches)
Linking Member 88: Length: about 42.8 cm (about 16.86 inches)

The assembly 10 of Example 2 is operationally configured for operation by persons and equipment weighing up to about 136.1 kg (about 300 pounds).

EXAMPLE 3

Figure 25:
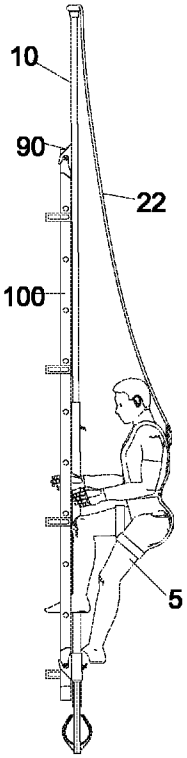
FIG. 25 is another simplified illustration of an individual using the fall arrest ladder assist of FIG. 12 with a fixed ladder.
Figure 24:
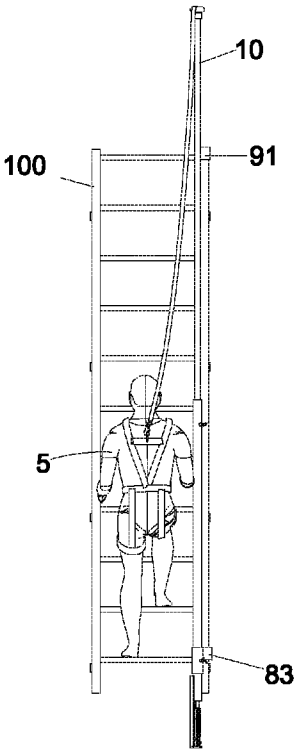
FIG. 24 is another simplified illustration of an individual using the fall arrest ladder assist of FIG. 12 with a fixed ladder.
Figure 23:
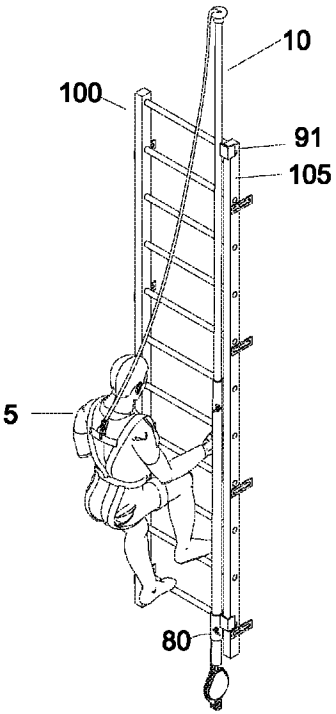
FIG. 23 is a simplified illustration of an individual using the fall arrest ladder assist of FIG. 12 with a fixed ladder.

In a third non-limiting example, with attention to FIGS. 23-25, an individual 5 is shown using the assembly 10 as described in Example 2.

Persons of ordinary skill in the art will recognize that many modifications may be made to the present application without departing from the spirit and scope of the application. The embodiment(s) described herein are meant to be illustrative only and should not be taken as limiting the invention, which is defined in the claims.

I claim:

1. A ladder assist including:

a telescoping assembly including a first member and a second member operationally configured to telescope in and out from the first member, the telescoping assembly having a central axis and a first ladder attachment assembly for engaging a first location on a fixed ladder and a second ladder attachment assembly for engaging a second location on the fixed ladder, the fixed ladder having a frame including opposing side rails and a plurality of rungs disposed there between;

a self-retractable lifeline in communication with the telescoping assembly;

the first ladder attachment assembly and the second ladder attachment assembly being operationally configured to apply opposing forces to the fixed ladder for securing the telescoping assembly to the fixed ladder whereby the first ladder attachment assembly is operationally configured to apply a first force to the underside of a first ladder rung of the fixed ladder and the second ladder attachment assembly is operationally configured to apply an opposing second force to the topside of a second ladder rung located higher on the fixed ladder than the location of the first ladder rung;

wherein the first ladder attachment assembly includes a collar operationally configured to be adjusted along the length of the first member, the collar having (1) a hook member attached to an outer surface of the collar and extending out there from at a first location on the collar and (2) a non-linear lateral member attached to the outer surface of the collar and extending out there from at a second location on the collar ninety degrees relative to said first location, the hook member being operationally configured to apply the first force and the non-linear lateral member being operationally configured to contact the frame to prevent horizontal movement of the telescoping assembly toward a midline of the fixed ladder;

wherein the telescoping assembly includes an internal pathway and wherein the self-retractable lifeline includes a retractable reel attached at an end of the first member, the retractable reel having a mouth in-line along the central axis in a manner effective to conceal at least part of the lifeline within the internal pathway of the telescoping assembly.

2. The ladder assist of claim 1 wherein the second ladder attachment assembly is operationally configured to prevent vertical movement of the second member toward the first ladder attachment assembly and prevent horizontal movement of the second member toward the midline of the fixed ladder when the telescoping assembly is secured to the fixed ladder.

3. The ladder assist of claim 1 wherein the first ladder attachment assembly and the second ladder attachment assembly are operationally configured to prevent movement of the telescoping assembly along three axes relative the fixed ladder when the telescoping assembly is secured to the fixed ladder.

4. The ladder assist of claim 1 wherein the first ladder rung is a lowermost ladder rung and the second ladder rung is an uppermost ladder rung of the fixed ladder.

5. The ladder assist of claim 4 wherein the second ladder attachment assembly includes an inverted hook member operationally configured to engage the uppermost ladder rung.

6. The ladder assist of claim 1 wherein the ladder assist is securable to the fixed ladder in a manner effective for about one-third of the telescoping assembly to extend out beyond an upper end of the fixed ladder.

7. The ladder assist of claim 1 wherein the second ladder attachment assembly is attached to the second member.

8. The ladder assist of claim 7 wherein the second ladder attachment assembly includes (1) an inverted hook member attached to and extending out from an outer surface of the second member at a first location in a manner effective to engage the second ladder rung and (2) a lateral member attached to and extending out from the outer surface of the second member at a second location along the second member ninety degrees relative to the first location in a manner effective to contact the frame of the fixed ladder to prevent horizontal movement of the telescoping assembly toward a midline of the fixed ladder.

9. The ladder assist of claim 1 wherein a distal end of the telescoping assembly includes a redirection surface member for supporting the lifeline, the redirection surface member having (1) a circular rounded surface defining a bending point of the lifeline and (2) a neck member for mating with the second member.

10. The ladder assist of claim 9 wherein the redirection surface member includes an open mouth there through, the mouth being in communication with the internal pathway.

11. A ladder assist releasably attachable to a fixed ladder having a frame including opposing side rails and a plurality of rungs disposed there between including:

a telescoping assembly including a first member and a second member operationally configured to telescope in and out from the first member, the telescoping assembly having an internal pathway and a first ladder attachment assembly for engaging an underside of a first ladder rung of a fixed ladder and a second ladder attachment assembly for engaging a topside of a second ladder rung of the fixed ladder, the first ladder attachment assembly being operationally configured to apply a first force to the underside of the first ladder rung and the second ladder attachment assembly being operationally configured to apply a second opposing force to the topside of the second ladder rung in a manner effective to secure the telescoping assembly to the fixed ladder; and a self-retractable reel including a lifeline, the self-retractable reel being in communication with the telescoping assembly at a proximal end of the first member in a manner effective to conceal at least part of the lifeline extending out from the reel within the internal pathway of the telescoping assembly;

wherein the second ladder attachment assembly includes an inverted hook member attached at a first location on an outer surface of the second member in a manner effective to engage the second ladder rung and a non-linear lateral member attached at a second location on the outer surface of the second member ninety degrees relative to the first location in a manner effective to contact the frame of the fixed ladder to prevent horizontal movement of the telescoping assembly toward a midline of the fixed ladder;

wherein the first ladder attachment assembly is movably secured to the first member.

12. The ladder assist of claim 11 wherein the first ladder attachment assembly includes a collar operationally configured to be adjusted along the length of the first member, the collar having an upright hook member attached to an outer surface of the collar at a first location and a non-linear lateral member attached to the outer surface of the collar at a second location ninety degrees relative to the first location.

13. A method of preventing a fall during access and egress of a fixed ladder of a transportation carrier comprising:

providing the ladder assist of claim 1 wherein the second ladder attachment assembly is attached to the second member and includes an inverted hook member attached to and extending out from an outer surface of the second member at a first location and a lateral member attached to and extending out from the outer surface of the second member at a second location ninety degrees relative to the first location;

with the telescoping assembly in an extended position securing the telescoping assembly to the fixed ladder by placing the hook member of the first ladder attachment assembly in an engagement position with a lowermost rung and placing the hook member of the second ladder attachment assembly in an engagement position with an uppermost rung and securing at least one lateral member to the frame of the fixed ladder; and attaching a free end of the lifeline to a user of the fixed ladder during operation of the ladder assist.

14. The method of claim 13, wherein said securing of the telescoping assembly includes:

hanging the hook member of the second ladder attachment assembly over the uppermost rung;

directing the first ladder attachment assembly to an engagement position with the lowermost rung; and securing at least one lateral member to the frame of the fixed ladder.

15. The method of claim 13 further including:

detaching the free end of the lifeline from the user once the user is atop the transportation carrier;

reattaching the free end of the lifeline to the user prior to the user descending down the fixed ladder; and once the user has fully descended down the fixed ladder, detaching the lifeline from the user, after which the telescoping assembly may be detached from the fixed ladder.

16. The method of claim 13 further including:

detaching the free end of the lifeline from the user once the user is atop the transportation carrier;

reattaching the free end of the lifeline to the user prior to the user descending down the fixed ladder; and once the user has fully descended down the fixed ladder, (1) detaching the lifeline from the user, (2) detaching the telescoping assembly from the fixed ladder and (3) securing the telescoping assembly to a different fixed ladder of a transportation carrier.

* * * * *